US008748722B2

(12) United States Patent
Ruttenberg

(10) Patent No.: US 8,748,722 B2
(45) Date of Patent: Jun. 10, 2014

(54) HINGED DRUMSTICK

(71) Applicant: HingeStix LLC, Cherry Hill, NJ (US)

(72) Inventor: Samuel Ruttenberg, Cherry Hill, NJ (US)

(73) Assignee: HingeStix LLC, Cherry Hill, NJ (US)

( * ) Notice: Subject to any disclaimer, the term of this patent is extended or adjusted under 35 U.S.C. 154(b) by 0 days.

(21) Appl. No.: 13/772,837

(22) Filed: Feb. 21, 2013

(65) Prior Publication Data

US 2013/0192443 A1 Aug. 1, 2013

Related U.S. Application Data

(63) Continuation-in-part of application No. 13/314,244, filed on Dec. 8, 2011, now Pat. No. 8,618,397, which is a continuation-in-part of application No. 12/774,408, filed on May 5, 2010, now Pat. No. 8,253,003, which is a continuation-in-part of application No. 12/610,670, filed on Nov. 2, 2009, now Pat. No. 7,897,859.

(60) Provisional application No. 61/184,467, filed on Jun. 5, 2009.

(51) Int. Cl.
*G10D 13/02* (2006.01)

(52) U.S. Cl.
USPC ..... 84/422.4

(58) Field of Classification Search
USPC ..... 84/422.4
See application file for complete search history.

(56) References Cited

U.S. PATENT DOCUMENTS

| | | | |
|---|---|---|---|
| 1,362,769 | A | 12/1920 | White |
| 1,481,596 | A | 1/1924 | Fletcher et al. |
| 2,521,336 | A | 9/1950 | Bramson |
| D206,134 | S | 11/1966 | Gussak |
| 3,365,108 | A | 1/1968 | Giba |
| 3,859,887 | A | 1/1975 | Buchanan |
| 3,866,508 | A | 2/1975 | Huslig |
| 3,893,364 | A | 7/1975 | Harrison |
| 4,269,105 | A | 5/1981 | Salmon |
| 5,370,030 | A | 12/1994 | Horne |
| 5,503,056 | A | 4/1996 | Evans |

(Continued)

OTHER PUBLICATIONS

Notice of Allowance for U.S. Appl. No. 13/314,244, mailed Jul. 24, 2013.

(Continued)

*Primary Examiner* — Robert W Horn
(74) *Attorney, Agent, or Firm* — Pergament Gilman & Cepeda LLP

(57) ABSTRACT

A percussion instrument is disclosed that may include a body having a longitudinal axis extending from a butt end to a striking end thereof and at least one hole extending through the thickness of the body substantially along or through an axis that is different from the longitudinal axis; and a grasping mechanism having a first grip plate at a first end thereof and a second grip plate at a second end thereof, and at least one shaft extending through the hole. The percussion instrument may further include a compliance mechanism disposed between the first and second grip plates, enabling the first and second grip plates to move closer together in response to a compressive force applied. One or more recesses or bores may be used for a more compact design, and the at least one hole may be on an angle to accommodate different drumming styles.

28 Claims, 14 Drawing Sheets

(56) References Cited

U.S. PATENT DOCUMENTS

| | | | | |
|---|---|---|---|---|
| D386,779 | S | 11/1997 | Burgos | |
| 6,271,451 | B1 | 8/2001 | Gress | |
| 6,346,662 | B1 | 2/2002 | Sielaff | |
| 6,365,813 | B1 | 4/2002 | Gress | |
| D473,259 | S | 4/2003 | Izen et al. | |
| 6,924,423 | B2 | 8/2005 | O'Donnell | |
| 7,173,176 | B2 | 2/2007 | Nybye | |
| 7,323,627 | B2 | 1/2008 | Sweeney | |
| 7,375,271 | B1 | 5/2008 | Zelinsky | |
| 7,435,889 | B1 | 10/2008 | Heidt | |
| 7,473,836 | B2 | 1/2009 | Barke | |
| 7,897,859 | B2 | 3/2011 | Ruttenberg | |
| 7,960,635 | B2 | 6/2011 | Rice | |
| 7,968,782 | B2 | 6/2011 | Mackie | |
| 8,253,003 | B2 | 8/2012 | Ruttenberg | |
| 8,618,397 | B2 | 12/2013 | Ruttenberg | |
| 2009/0007755 | A1 | 1/2009 | Rivers, Jr. | |
| 2010/0058919 | A1 | 3/2010 | Rice | |
| 2010/0307317 | A1 | 12/2010 | Ruttenberg | |
| 2010/0307318 | A1 | 12/2010 | Ruttenberg | |
| 2012/0073422 | A1 | 3/2012 | Ruttenberg | |
| 2013/0192443 | A1 * | 8/2013 | Ruttenberg | 84/422.4 |

OTHER PUBLICATIONS

Notice of Allowance for U.S. Appl. No. 12/610,670, dated Dec. 21, 2010.
Office Action for U.S. Appl. No. 12/774,408, dated Jan. 18, 2012.
Office Action for U.S. Appl. No. 12/774,408, dated Apr. 20, 2012.
Notice of Allowance and Interview Summary for U.S. Appl. No. 12/774,408, dated Jun. 25, 2012.
Interview Summary clarifying reasons for allowance for U.S. Appl. No. 12/774,408, dated Jul. 17, 2012.
Office Action for U.S. Appl. No. 13/314,244, dated Feb. 6, 2013.
Interview Summary for U.S. Appl. No. 13/314,244, dated Apr. 11, 2013.
Notice of Allowance for U.S. Appl. No. 13/314,244, dated Jul. 24, 2013.
Interview Summary clarifying reasons for allowance for U.S. Appl. No. 13/314,244, dated Aug. 14, 2013.
Office Action for U.S. Appl. No. 12/774,408, mailed Jan. 18, 2012.
Office Action for U.S. Appl. No. 12/774,408, mailed Apr. 20, 2012.
Notice of Allowance for U.S. Appl. No. 12/774,408, mailed Jun. 25, 2012.
Office Action for U.S. Appl. No. 13/314,244, mailed Feb. 6, 2013.
Notice of Allowance for U.S. Appl. No. 12/610,670, mailed Dec. 21, 2010.

* cited by examiner

HINGED DRUMSTICK

CROSS-REFERENCE TO RELATED APPLICATIONS

This application is a Continuation-in-Part of U.S. Non-Provisional patent application Ser. No. 13/314,244, filed Dec. 8, 2011 entitled "Hinged Drumstick", which has issued as U.S. Pat. No. 8,618,397 on Dec. 31, 2013, and which is a Continuation-in-Part of U.S. Non-Provisional patent application Ser. No. 12/774,408, filed May 5, 2010, entitled "Hinged Drumstick", which has issued as U.S. Pat. No. 8,253,003 on Aug. 28, 2012, and which is a Continuation-in-Part of U.S. Non-Provisional application Ser. No. 12/610,670, filed Nov. 2, 2009, entitled "Hinged Drumstick" which application has issued as U.S. Pat. No. 7,897,859 on Mar. 1, 2011, and claims the benefit of U.S. Provisional Patent Application Ser. No. 61/184,467, filed Jun. 5, 2009, entitled "Ruttenberg's Hinge Drumstick", now expired, the entire disclosures of which applications and patents are hereby incorporated by reference herein.

BACKGROUND OF THE INVENTION

This invention relates in general to musical percussion instruments, and more particularly to drumsticks for playing percussion instruments.

Drumsticks typically include a butt end, a striking end, and an intermediate region located in between the butt end and the striking end along the length of the body of the drumstick. The intermediate region generally includes a balance point (fulcrum) about which the drumstick pivots when the tip or striking point of the drumstick rebounds from contact with a drum skin (i.e. a head).

The drumstick is generally held at or near the balance point during use, since gripping the stick at this point enables maximum motion of the stick as it strikes and then rebounds from the surface of a drum or other percussion device. When held too tightly there is too much friction, and the player inhibits the motion (rebound) of the drumstick. In order to properly train students learning to play percussion instruments, such as, for instance, a snare drum, it is helpful not only to aid the student in grasping the stick at the balance point, but to encourage gripping of the stick in the proper manner. The latter is of particular importance in learning a technique in which the stick is effectively hinged between the thumb and forefinger of the user's hand, and the last three fingers of the hand controlling the rate of movement of the stick are located underneath the drumstick to control the speed of motion.

Drumsticks have been devised which attempt to minimize friction which slows down the motion (rebound) of the drumstick, for example, by isolating of the body of the drumstick from the fingers with some resilient material which can be gripped with firmness and which will not completely inhibit free motion of the drumstick. Another approach has been to provide some form of locator at the balance point. However, such designs do not establish freedom from restraint in pivotal movement as the stick rebounds from the drum. Moreover, they do not facilitate grasping and control of the drumstick at the balance point, especially for the student learning the fingertip control method of playing drums.

The aforementioned problem relates generally to drumming but may be particularly relevant depending on how a user wishes to use a drumstick, particularly with respect to one or more drumming styles. In drumming, the traditional grip (also called rudimental) style is typically used for the left hand (i.e., where a portion of the left hand is positioned substantially under the drumstick). The right hand may stay on top of the other corresponding drumstick as in the matched grip. Historically, such a drumming style developed during times of war because, when soldiers were marching into battle, the drum would be slung over the shoulder of the drummer and would rest on the left leg of the drummer. Such a configuration caused the drum to tilt at an angle whereby having the left hand on top of the stick (like the right hand for the other corresponding drumstick) would cause the drummer's elbow to stick out in the air and cause fatigue. The solution was to hold the stick in the left hand underneath the stick such that the drumstick would rest in the drummer's hand between the thumb and the third and fourth fingers of the left hand. This traditional grip is still used today in marching drumming in Jazz drumming.

Thus, it is a problem in the art that prior approaches to providing unrestrained pivotal motion of the drumstick do not also enable a user to exercise sufficient control over the drumstick.

SUMMARY OF THE INVENTION

According to one aspect, the present invention is directed to a percussion instrument that may include a body having a longitudinal axis extending from a butt end to a striking end thereof and at least one hole extending along a transverse axis through the thickness of the body; a grasping mechanism having a first grip plate at a first end thereof and a second grip plate at a second end thereof, and a shaft extending through the hole in the body; and a compliance mechanism disposed between the first and second grip plates, enabling the first and second grip plates to be brought closer together in response to a compressive force applied to the grasping mechanism.

According to another aspect, the invention is directed to a percussion instrument that may include a body having a longitudinal axis extending from a butt end to a striking end thereof, at least one hole extending through a first crosswise hole through the diameter of the body, and a substantially cylindrical slot substantially centered on the crosswise hole; a pin extending through the crosswise hole through the body about which the body is able to rotate; and a disk located at least partially within the slot and rotatable about the pin.

According to another aspect, a percussion instrument may include a body having a longitudinal axis extending from a butt end to a striking end thereof and at least one hole extending substantially along and/or through a substantially transverse axis of the body through the thickness thereof; a grasping mechanism having a first grip plate at a first end thereof and a second grip plate at a second end thereof, at least one shaft extending from the first grip plate through a first hole of the at least one hole in the body to the second grip plate, and a releasable connection between the first grip plate and the second grip plate such that the grasping mechanism operates to be positioned in the first hole of the at least one hole and the first grip plate and the second grip plate operate to be disconnected from each other and/or connected/re-connected to each other such that the grasping mechanism operates to be positioned or re-positioned in the at least one hole; and a compliance mechanism disposed between the first and second grip plates, enabling the first and second grip plates to be moved closer together in response to a compressive force applied to the grasping mechanism.

The releasable connection may include at least one of: a threaded connection; a snap or press fit connection and a friction fit connection.

The first hole of the at least one hole may include at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (i) closer to each other than when not having the at least one recess or bore; and/or (ii) closer to the surface of the body of the percussion instrument. At least the first hole of the at least one hole may include at least one of: (i) a first recess or bore of the at least one recess or bore at a first end of the first hole operating to permit at least a portion of the first grip plate to be disposed therein; and (ii) a second recess or bore of the at least one recess or bore at a second end of the first hole operating to permit at least a portion of the second grip plate to be disposed therein. The at least one hole may include at least two holes, and each of the at least two holes may include the first and second recesses or bores at respective ends thereof. The at least one hole may be sized and shaped to operate to at least one of: permit the grasping mechanism and/or the compliance mechanism to be positioned therein such that a zone of space of a predetermined size is located between the at least one hole and the grasping mechanism and/or the compliance mechanism, thereby permitting the grasping mechanism and/or the compliance mechanism to move freely within the at least one hole; permit the grasping mechanism and/or the compliance mechanism to be positioned therein and to be spaced away therefrom such that the grasping mechanism and/or the compliance mechanism operates to make one or more audible noises when hitting against the first hole of the at least one hole, thereby permitting the grasping mechanism and/or the compliance mechanism to move freely within the at least one hole; and permit the grasping mechanism and/or the compliance mechanism to be positioned therein and to be in contact with at least a portion thereof.

At least one of the first grip plate and the second grip plate may include a pad thereon, the pad operating to provide a comfortable and/or ergonomic surface for gripping at least the grasping mechanism of the percussion instrument. The pad may include a surface that is at least one of: curved, sloped, chamfered, convex, concave, rounded, substantially flat, and recessed.

One or more components of at least one of the grasping mechanism, the compliance mechanism and the body may be made of at least one of: wood, plastic, metal, rubber, hard rubber, polytetrafluoroethylene, carbon fiber, fiber, and any combination of the foregoing.

According to yet another aspect, a percussion instrument may include a body having a longitudinal axis extending from a butt end to a striking end thereof and at least one hole extending substantially along and/or through a substantially transverse axis of the body through the thickness thereof; and a grasping mechanism having a first grip plate at a first end thereof and a second grip plate at a second end thereof, at least one shaft extending from the first grip plate through a first hole of the at least one hole in the body to the second grip plate, and a releasable connection between the first grip plate and the second grip plate such that the grasping mechanism operates to be positioned in the first hole of the at least one hole and the first grip plate and the second grip plate operate to be disconnected from each other and/or connected/re-connected to each other such that the grasping mechanism operates to be positioned or re-positioned in the at least one hole.

The releasable connection may be at least one of: a threaded connection; a snap or press fit connection and a friction fit connection.

The first hole of the at least one hole may include at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (i) closer to each other than when not having the at least one recess or bore; and/or (ii) closer to the surface of the body of the percussion instrument. At least the first hole of the at least one hole may include: (i) a first recess or bore of the at least one recess or bore at a first end of the first hole operating to permit at least a portion of the first grip plate to be disposed therein; and (ii) a second recess or bore of the at least one recess or bore at a second end of the first hole operating to permit at least a portion of the second grip plate to be disposed therein. The at least one hole may include at least two holes, each of the at least two holes including the first and second recesses or bores at respective ends thereof. The at least one hole may be sized and shaped to operate to at least one of: permit the grasping mechanism to be positioned therein such that a zone of space of a predetermined size is located therebetween, thereby permitting the grasping mechanism to move freely within the at least one hole; permit the grasping mechanism to be positioned therein and to be spaced away therefrom such that the grasping mechanism operates to make one or more audible noises when hitting against the first hole of the at least one hole, thereby permitting the grasping mechanism to move freely within the at least one hole; and permit the grasping mechanism to be positioned therein and to be in contact with at least a portion thereof.

At least one of the first grip plate and the second grip plate may include a pad thereon, the pad operating to provide a comfortable and/or ergonomic surface for gripping at least the grasping mechanism of the percussion instrument. The pad may include a surface that is at least one of: curved, sloped, chamfered, convex, concave, rounded, substantially flat, and recessed.

One or more components of at least the grasping mechanism and the body may be made of at least one of: wood, plastic, metal, rubber, hard rubber, polytetrafluoroethylene, carbon fiber, fiber and any combination of the foregoing.

According to yet a further aspect of the present invention, a percussion instrument may include: a body having a longitudinal axis extending from a butt end to a striking end thereof and at least one hole extending substantially along and/or through a substantially transverse axis of the body through the thickness thereof; and a hinge having a first disc at a first end thereof and a second disc at a second end thereof, at least one shaft extending from the first disc through the at least one hole in the body to the second disc, and a releasable connection between the first disc and the second disc such that the grasping mechanism operates to be positioned in the at least one hole and the first disc and the second disc operate to be disconnected from each other and/or connected/re-connected to each other such that the hinge operates to be positioned in another of the at least one hole and/or re-positioned in the at least one hole, wherein the at least one hole includes at least one recess or bore disposed or located substantially at an end thereof, the at least one recess or bore being sized and/or shaped to receive at least a portion of at least one of the first disc and the second disc therein such that the at least one recess or bore operates to permit the first disc and/or the second disc to be positioned at least one of: (i) closer to each other than when not having the at least one recess or bore; and/or (ii) closer to the surface of the body of the percussion instrument. The percussion instrument may include at least one of: (i) the releasable connection comprising at least one of: a threaded connection; a snap or press fit connection and a friction fit connection; (ii) the at least one hole including at least one of: a first of the at least one recess or bore at a first end of the at least one hole operating to permit at least a portion of the first disc to be disposed therein, and a second of the at least one recess or bore at a second end of the at least one hole operating to permit at least a portion of the second disc to be disposed therein; (iii) at least one of the first disc and the second disc including a pad thereon, the pad operating to provide a more comfortable and/or ergonomic surface for gripping at least the hinge of the percussion instrument and the pad including a surface that is at least one of: curved, sloped, chamfered, convex, concave, rounded, substantially flat, and recessed; (iv) the at least one hole being sized and shaped to operate to at least one of: permit the hinge to be positioned therein such that a zone of space of a predetermined size is located therebetween, thereby permitting the hinge to move freely within the at least one hole; permit the hinge to be positioned therein and to be spaced away therefrom such that the hinge operates to make one or more audible noises when hitting against the at least one hole, thereby permitting the hinge to move freely within the at least one hole; and permit the hinge to be positioned therein and to be in contact with at least a portion thereof; and (v) one or more components of at least one of the hinge and body being made of at least one of: wood, plastic, metal, rubber, hard rubber, polytetrafluoroethylene, carbon fiber, fiber and any combination of the foregoing.

Other aspects, features, advantages, etc. will become apparent to one skilled in the art when the description of the preferred embodiments of the invention herein is taken in conjunction with the accompanying drawings.

BRIEF DESCRIPTION OF THE DRAWINGS

For the purposes of illustrating the various aspects of the invention, wherein like numerals indicate like elements, there are shown in the drawings simplified forms that may be employed, it being understood, however, that the invention is not limited by or to the precise arrangements and instrumentalities shown. To assist those of ordinary skill in the relevant art in making and using the subject matter hereof, reference is made to the appended drawings and figures, wherein.

DETAILED DESCRIPTION OF THE PREFERRED EMBODIMENTS

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" or "in an embodiment" in various places in the specification do not necessarily all refer to the same embodiment.

Figure 1:
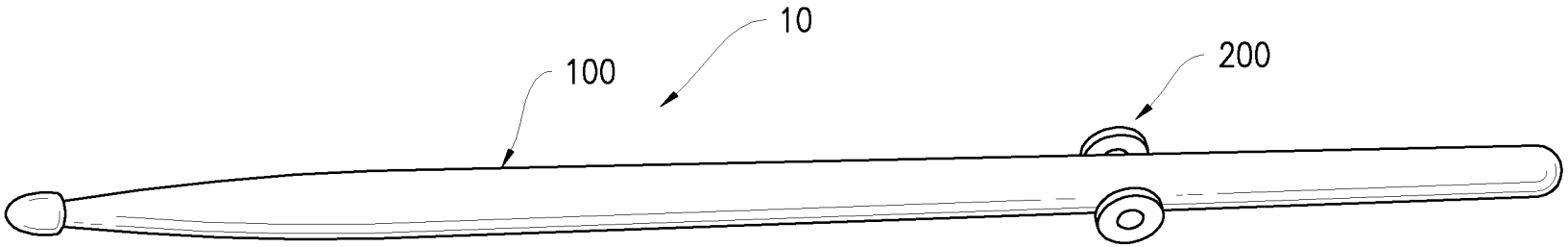
FIG. 1 is a perspective view of a drumstick in accordance with an embodiment of the present invention.

FIG. 1 is a perspective view of a drumstick 10 in accordance with an embodiment of the present invention. The drumstick 10 of FIG. 1 may include body 100 and hinge 200. These features will be discussed in greater detail in connection with FIG. 2.

Figure 2:
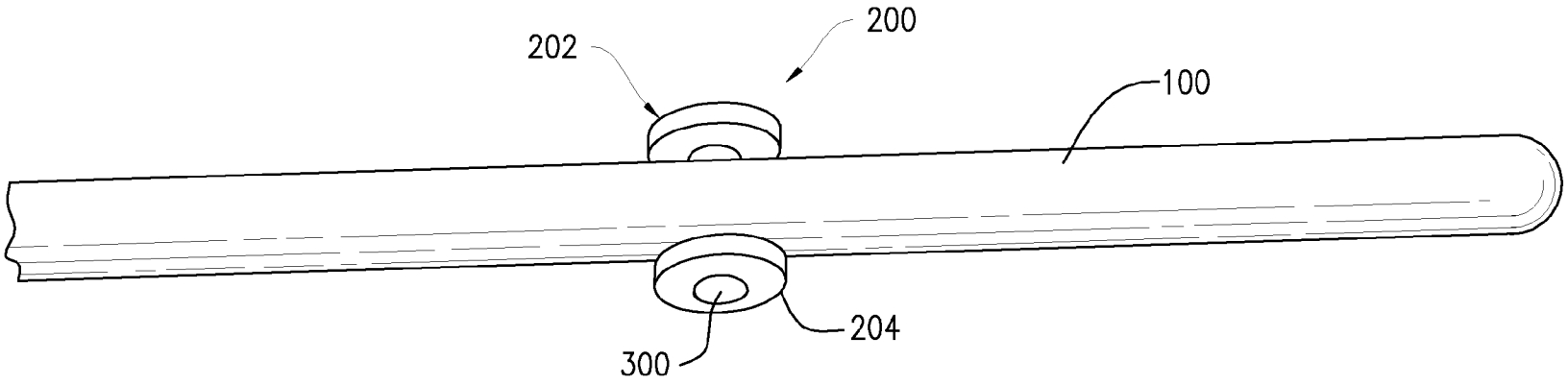
FIG. 2 is a perspective view of a portion of a drumstick in accordance with an embodiment of the present invention.

FIG. 2 shows body 100 and hinge 200 which may include hinge elements 202 and 204, and fastener 300. Fastener 300 may simply be a pin that is attachable to the hinge elements 202 and 204. Alternatively, fastener 300 may have a more complex geometry and a plurality of parts as discussed later herein.

Figure 3:
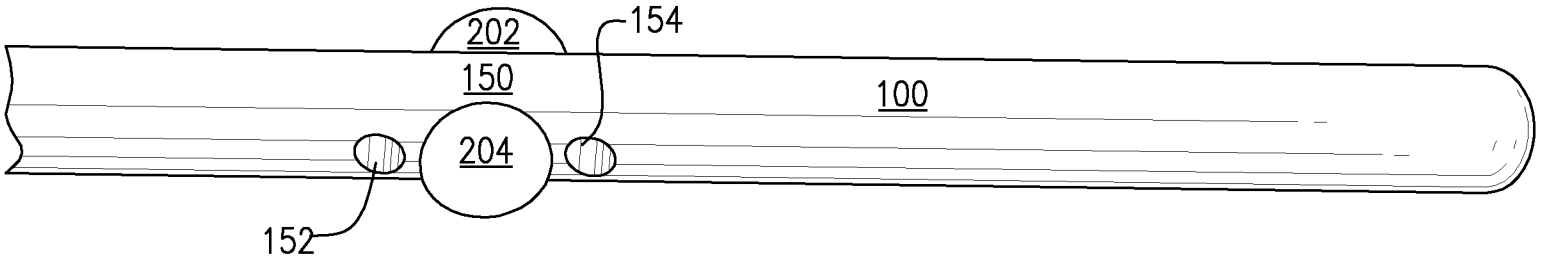
FIG. 3 is a perspective view of a portion of a drumstick in accordance with another embodiment of the present invention.

FIG. 3 is a perspective view of a portion of body 100 of drumstick 10. Body 100 may include holes 150, 152, and 154 and may be coupled to hinge elements 202 and 204. The location of hole 150 can only be shown indirectly as the nearest opening of hole 150 (in the view of FIG. 3) is obscured by hinge element 204. The distribution of holes 150, 152, and 154 preferably enables a user of drumstick 10 to select the most desirable pivot point along the length of body 100 at which to install hinge elements 202 and 204 forming fastener 300. Preferably, hinge elements 202 and 204 may be readily disconnected from one another, for example by unscrewing a threaded connection, and re-connected within a preferred hole among holes 150, 152, and 154.

Figure 4:
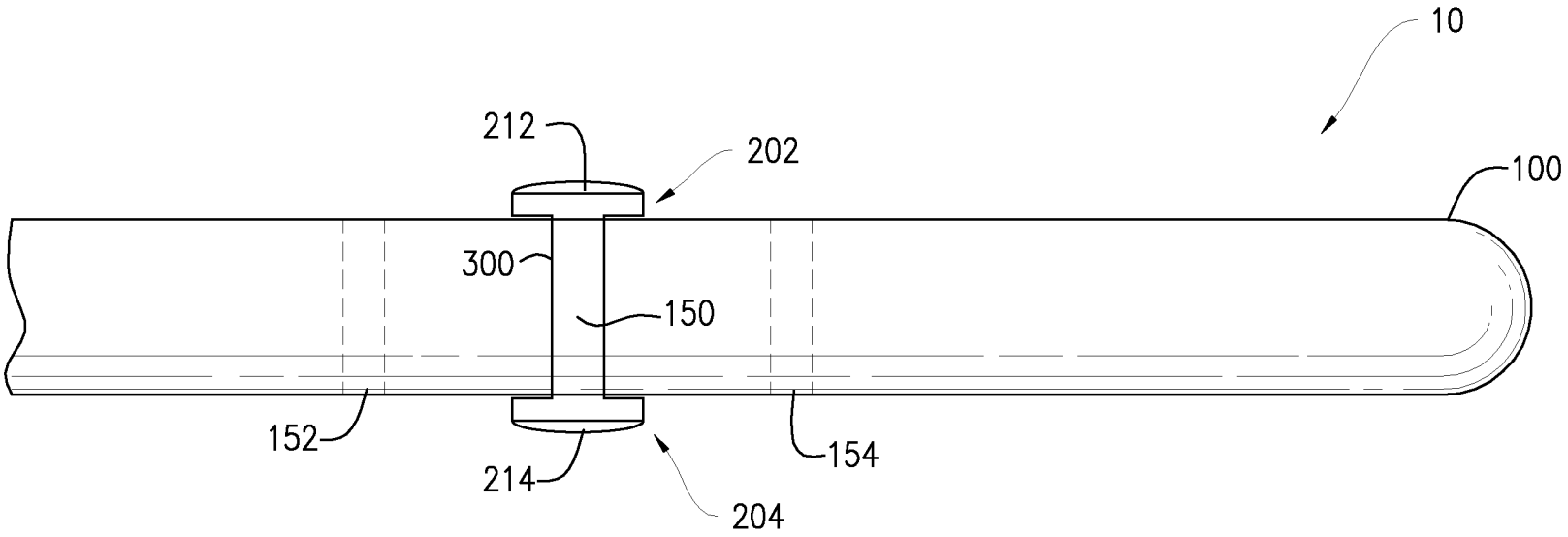
FIG. 4 is a sectional view of a drumstick in accordance of an embodiment of the present invention.

FIG. 4 is a sectional view of drumstick 10 in accordance of an embodiment of the present invention. FIG. 4 shows body 100 having holes 150, 152, and 154; fastener 300 inserted through hole 150; and hinge elements 202 and 204 having pads 212 and 214, respectively. Pads may be attached to their respective hinge elements to provide more desirable contact characteristics for a user of the drumstick 10. Alternatively, grip pads 212, 214 may be omitted, and each hinge element 202, 204 could be formed using a single integral part.

Figure 5:
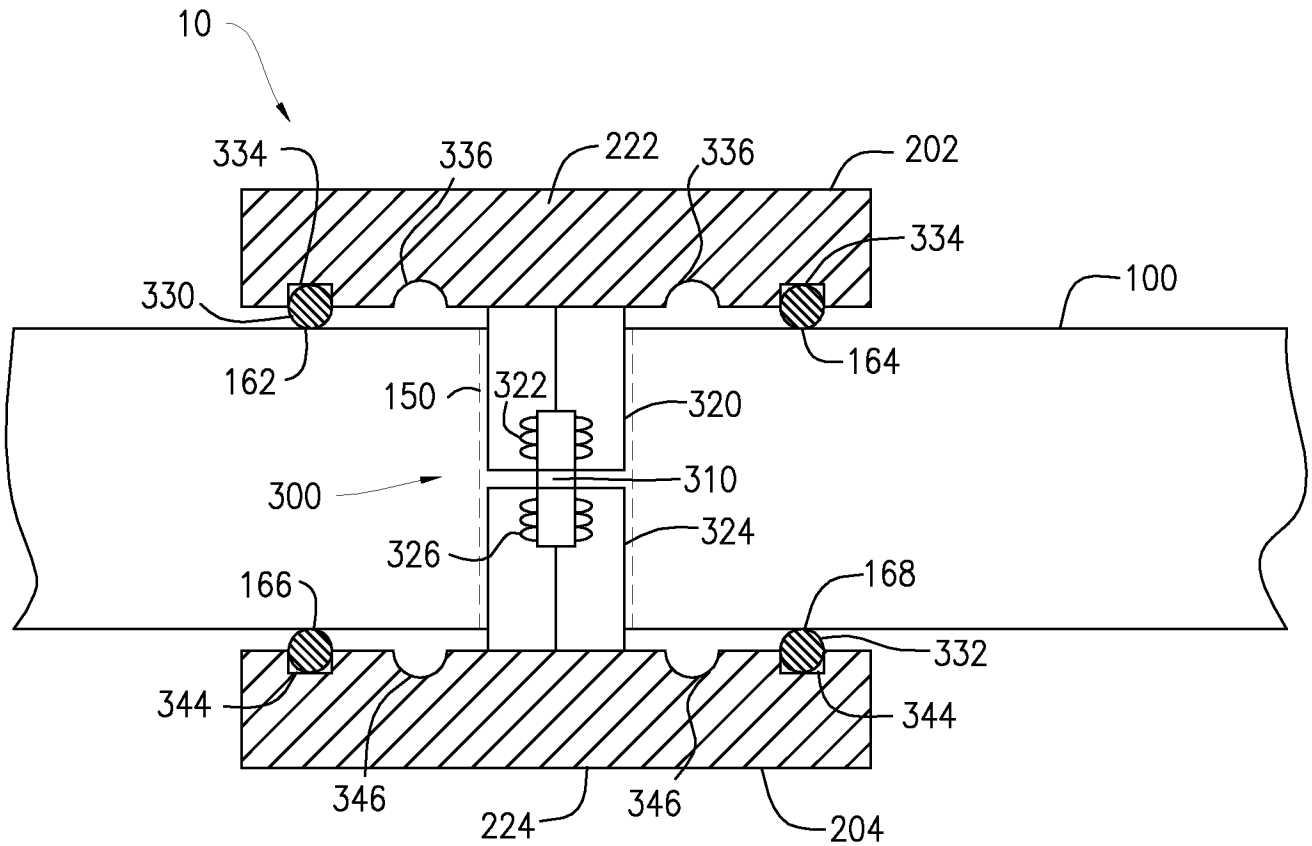
FIG. 5 is a more detailed sectional view of the drumstick of FIG. 4 in accordance with an embodiment of the present invention.

In this embodiment, hinge elements 202 and 204 may be readily disconnected from one another and then re-attached within a different one of three available holes 150, 152, 154. This disconnection and reconnection of hinge elements 202 and 204 may be achieved by unscrewing one of the threaded connections securing hinge elements 202, 204 together (see FIG. 5), and then re-connecting the two parts together in a different hole, selected from holes 150, 152, and 154. While a threaded connection is shown in FIG. 5, the present invention is not limited to this connection means. Other means of connecting two rods together may be practiced, such as a press fit, friction fit, etc. Moreover, while three holes are shown in FIGS. 3-4, it will be appreciated that in alternative embodiments, body 100 may include fewer or more than three holes.

FIG. 5 is a more detailed schematic sectional view of the percussion instrument 10 of FIG. 4 in accordance with an embodiment of the present invention. Percussion instrument 10 is preferably a drumstick but is not limited to this embodiment. Percussion instrument 10 may be any one of a number of other possible percussion instruments, including for instance, a Timpani stick.

Drumstick 10 of FIG. 5 may include body 100 and hinge 200. Hinge 200 may include hinge elements 202 and 204, set screw 310, and/or O-rings 330 and 332. Body 100 may be a conventional drumstick body that is preferably made of wood, though other materials may be employed. Body 100 may include flat portions 162, 162, 166, and 168 that are machined on a portion of body 100 that contacts O-rings 330 and 332 to maximize the surface area of contact between body 100 and the O-rings 330 and 332.

Hinge element 202 may include disk portion 222, shaft 320, open radius area (deflection recess) 336 for flexing hinge element 202 upon the application of force thereto, and groove 334 for housing O-ring 330. Similarly, hinge element 204 may include disk portion 224, shaft 326, deflection recess 346, and groove 344 for housing O-ring 332.

Fastener 300 may include shafts 320 and 324 of hinge elements 202 and 204 respectively. Fastener 300 may further include set screw 310 that may be disposed between shafts 320 and 324. Shafts 320 and 324 may include threaded regions 322 and 326, respectively, for engaging suitable portions of set screw 310. In other embodiments, shafts 320 and 324 may be configured to be capable of being directly screwed together without any need for an intervening set screw. Moreover, other mechanical attachment means may be provided for coupling shaft 320 of hinge element 202 and shaft 324 of hinge element 204.

Herein, the term "grasping mechanism" may refer to one or more parts included within hinge 200. The disk portions 222, 224 of hinge elements 202 and 204, respectively, may be referred to herein as grip plates. It will be appreciated that grip plates 222, 224 may, but need not be, disk shaped.

Hinge elements 202, 204 may be made of any desired material such as but not limited to wood, plastic, metal, polytetrafluoroethylene, or any combination of the foregoing. Shafts 320 324 may be made of the same materials as disk portions 222 and 224, or alternatively may be made of metal to strengthen the threaded connection with set screw 310. Set screw 310 is preferably made of metal, such as steel or aluminum. Alternatively, set screw 310 could be made of any other desirable material such as any of various plastics. O-rings 332 and 334 are preferably made of a suitably selected rubber. However, other materials may be used for O-rings 332, 334 if desired, such as, but not limited to plastic. Disk portions 222, 224 may be made of plastic, metal, or any other suitable material. While illustrated as disk-shaped, disk portions 222, 224 are not limited to having a disk-shaped geometry.

O-rings 330, 332 are disclosed herein as a mechanism for providing a "braking" function for the relative motion between body 100 and hinge elements 202 and 204. However, the present invention is not limited to the use of O-rings for this purpose, and other braking materials, which may be compressible materials, may be employed. Braking materials however are not limited to being compressible materials. Any material suitable for creating effective braking friction when brought into contact with the body 100 of drumstick 10 may be employed including but not limited to rubber, leather, one or more plastics of various types, wood, and/or metal. In other alternative embodiments, a combination of one or more of the foregoing materials may be employed.

In this section, the attachment means among the various parts are discussed. The disk portion 222 and shaft portion 320 of hinge element 202 may be two separate parts that are joined together. Alternatively, they form a single integral part. In one embodiment, portions 202 and 320 of hinge element 202 may be rotationally fixed with respect to one another. In other embodiments, shaft 320 may be capable of rotating freely with respect to disk portion 222. Arrangements analogous to the above may be applied to the connection between disk portion 224 and shaft portion 324 of hinge element 204.

Hinge elements 202 and 204 may be joined together by first attaching set screw 310 to the threaded portion 322 of shaft 320 of hinge element 202, and inserting the shaft portion 320 of hinge element 202 into hole 150 within body 100. Thereafter, the threaded portion 326 of shaft 324 of hinge element 324 may be threaded onto the free end of set screw 310. Once attached onto their respective ends of set screw 310, hinge elements 202 and 204 may be turned with respect to one another to secure a final attachment between the two parts. In another approach, the above process may be repeated in reverse, with the set screw 310 being first attached to hinge element 204, and hinge element 202 being threaded onto the assembly of set screw 310 and hinge element 204 within the interior of hole 150 of body 100.

Having described the individual parts, the materials the parts may be made of, and the interconnections between the parts, it remains to describe the operation of a preferred embodiment of the drumstick 10 of FIG. 5. Once fully assembled, and with no external force applied to force hinge elements 202 and 204 together, the body 100 of drumstick 10 is preferably pivotally mobile with respect to fastener 300 without any hindrance. A user may pick up drumstick 10 and hold it using disk portions (grip plates) 222 and 224 of hinge elements 202 and 204, respectively.

The user preferably initially holds the grip plates 222, 224 so as to apply force substantially at the center of the grip plates 222, 224 and thereby avoid deflecting the periphery of plates 222, 224 toward the o-rings 330, 332. In this manner, using the initial grasping position, body 100 is preferably freely pivotally mobile with respect to fastener 300, thereby enabling the desirable free rotational motion of body 100 for both learning and performing purposes.

Another benefit of using O-rings 330 and 332 is to prevent an undesirable clicking sound upon the impact of the striking end of drumstick 10, or other type of percussion instrument, with a drum skin, or other percussion surface. The possibility of a clicking sound upon impact of the drumstick with a drum skin arises from the presence of the apparatus of hinge 200 within and near body 100. An impact between body 100 and any portion of hinge 200 may produce the undesired clicking sound. The placement of O-rings 330 and 332 in the locations shown in FIG. 5 preferably operates to massively reduce and/or eliminate the undesired clicking sound by cushioning any undesired impact between hinge elements 202, 204 and body 100. It is noted that devices other than O-rings 330 and 332 may be employed to prevent the undesired impact between parts of hinge 200 and body 100.

When a user of drumstick 10 wishes to limit the rotational speed and/or the angular displacement of body 100 with respect to fastener 300, the user may shift the location of the compressive holding force on grip plates 222, 224 so as to deflect the edges of grip plates 222 and 224 about deflection recesses 334 and 344 respectively, and in turn cause O-rings 330 and 332 to impinge on body 100 of drumstick 10, which thereby operates to hinder the rotational motion of body 100 with respect to fastener 300. In this manner, the rotational speed and/or the angular motion range of body 100 with respect to fastener 300 may be controlled as a function of the location and magnitude of the compressive force applied by the user to the respective grip plates 222, 224. Moreover, the extent and location of the applied force is under the control of the user of drumstick 10, thereby enabling the user to either allow unimpeded pivotal motion of drumstick 10 or to controllably dampen the motion of drumstick 10 in response to the compressive force applied by the user.

Figure 6:
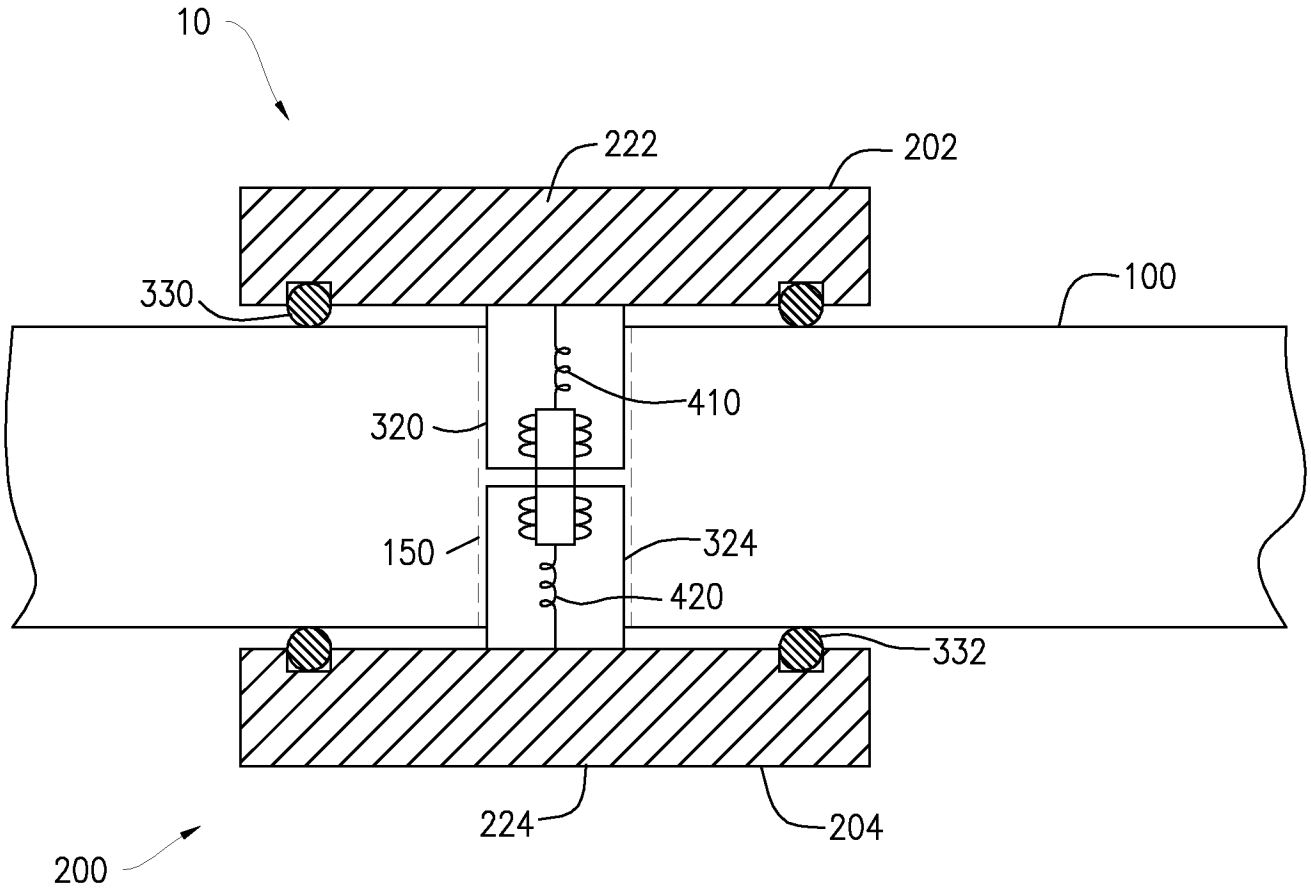
FIG. 6 is a schematic sectional view of a hinge coupled to a body of a drumstick in accordance with an embodiment of the present invention.

Another approach to enabling braking of the motion of body 100 with respect to hinge elements 202 and 204 is shown in FIG. 6. More specifically, an alternative approach to enabling the lateral (i.e. transverse-axis) compliance of hinge 200 in response to a compressive force so that O-rings 330 and 332 and can be moved toward body 100 to provide the desired braking function for the motion of body 100 with respect to hinge elements 202 and 204. Herein, the term "compliance device" may refer to the one or more springs 410, 420 of FIG. 6, or any other mechanism that is operable to enable disk portions 222 and 224 to move closer together in response to a compressive force applied thereto.

Accordingly, in FIG. 6, the deflection recesses 336, 346 may be omitted as shown. Instead, springs 410 and/or 420 may be employed to enable spring-loaded transverse-axis relative movement between disk portion 402 and disk portion 404. We turn now to the operation of the drumstick 10 of FIG. 6. When free motion of body 100 with respect to hinge 200 (including disk portions 202, 204) is desired, a user preferably holds disk portions 222, 224 with a compressive force sufficiently small so that O-rings 330, 332 do not impart any significant frictional braking force against body 100 of drumstick 10. When a user wishes to control the pivotal speed and/or extent of pivotal motion of body 100 with respect to disk portions 222, 224, the user may hold disk portions 222 and 224 with a compressive force sufficient to move these two parts towards one another and thereby bring O-rings 330, 332 into contact with body 100, thereby imparting a frictional braking force to body 100. Thereafter, the braking effect may adjusted by the user by adjusting the amount of compressive force used to hold disk portions 222 and 224. If desired, the compliance features of FIG. 5 and FIG. 6 could be combined within a single embodiment. Thus, one or both of springs 410, 420 could be included along with one or more of deflection recesses 336, 346.

While the above embodiments involves using O-rings 330, 332 as the entity making frictional contact with body 100, i.e. as the "braking material," the present invention is not limited to the use of O-rings. Other materials having other shapes may be employed either in addition to, or in place of, O-rings 330, 332. Other materials for the frictional contact device (i.e. the role of O-rings 330, 332 in FIG. 6) may include but are not limited to plastic, rubber, wood, fiberglass, metal, or any combination of the foregoing. In still other embodiments, the presence of a braking material separate from disk portions 222 and 224 could be omitted entirely. Where such separate braking material is omitted, friction between the internal surfaces of disk portions 202, 204 themselves and the body 100 could be used to brake and/or control the motion of body 100 with respect to the disk portions 222 and 224.

While two springs 410, 420 are shown in FIG. 6, it will be appreciated that three or more springs could be employed. Moreover, the invention may be practiced using only a single spring. Moreover, the one or more springs providing the needed compliance need not be located as springs 410 and 420 are shown in FIG. 6. Compliant devices, such as springs, could be located at any point that would allow disk portions 222 and 224 move closer together upon the application of compressive force between these two parts.

In one embodiment, a detent mechanism (not shown) could be employed along the structural path from disk portion 222 and 224 to establish a threshold force level below which disk portions 222 and 224 would not move closer together. At compressive force levels above the detent-mechanism compressive-force threshold, the compressive force would begin to force disk portions 222 and 224 together and initiate the braking function discussed above.

One or more embodiments of the present provide the benefits of enabling the player to visualize and feel the rebound; enabling the player to visualize and feel how a loose grip can benefit playing; enabling the player to work on velocity strokes, facilitating the whipping motion of the Moeller Technique; promoting finger technique for the Timpani technique; forcing the player to hold the stick in the correct manner by gripping the pads between the thumb and index finger; and/or allowing the player to have control of the stick by squeezing the pads for more technical playing such as for double strokes and buzz rolls.

In alternative embodiments, the following variations could be practiced to benefit various embodiments of the invention: (1) the use of different hole diameters; (2) the use of different hole locations; (3) the use of a different size or type of stick; (4) the use of a different drum stick tip (wood or nylon); (5) the use of a timpani stick; (6) a variation in the diameter of the portion of fastener 300 extending though hole 150; (7) the use of a different diameter (or shape) of the disk portions 222, 224 of the hinge elements 202, 204; and/or (8) the use of different means of securing together the shaft portions 320, 324 that engage one another within hole 150.

Figure 7A:
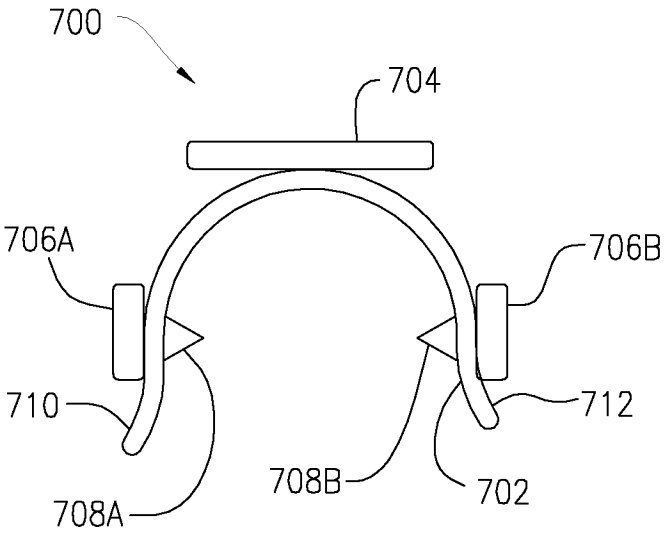
FIG. 7A is an elevational view of a hinge clip device suitable for attachment to a percussion instrument such as a drumstick in accordance with an embodiment of the present invention.
Figure 7B:
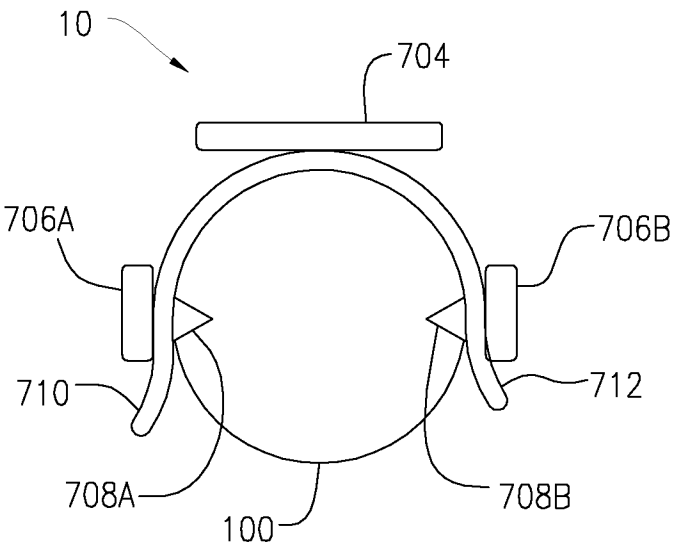
FIG. 7B is an elevational view of the hinge clip device of FIG. 7A attached to the body of a percussion instrument in accordance with an embodiment of the present invention.

FIG. 7A is an elevational view of a hinge clip device 700 suitable for attachment to a percussion instrument 10 such as a drumstick in accordance with an embodiment of the present invention. FIG. 7B is an elevational view of the hinge clip device 700 of FIG. 7A attached to the body of a percussion instrument 10 in accordance with an embodiment of the present invention.

Hinge clip device 700 may include handle 704, saddle 702, flaps 710, 712, pads 706A and 706B. Further, portions of saddle 702 inward of, and adjacent to, each of pads 706A and 706B preferably include pin-shaped protrusions 708A, 708B extending inwardly from flaps 710 and 712. The pin-shaped protrusions 708A, 708B are preferably located at corresponding positions on the inner surfaces of flaps 710 and 712, respectively, which protrusions combine to form an axis of rotation about which body 100 may rotate once a user applies compressive force to the outer surfaces of pads 706A and 706B. Saddle 702, which preferably includes flaps 710 and 712, is preferably a single, integral part. But, in alternative embodiments saddle 702 could be made from a plurality of parts that are appropriately joined together.

Saddle 702 is preferably a deformable member made of a material with an initial spring bias toward a position narrower than the diameter of body 100 to which it is intended to be attached, but with flap portions 710 and 712 capable of being forced apart to enable saddle 702 to be mounted onto a percussion-instrument body 100. Handle 704 may be attached (either removably or permanently) to saddle 702 using one or more of: glue, welding, screws, clips, clamps. Saddle 702 may be made of plastic, metal, fiberglass, or any other material capable of providing the needed spring action. Pads 706A and 706B may be made of any substantially solid material including but not limited to plastic, wood, and/or metal.

Protrusions 708A/708B may be made of metal, plastic, or other material suitable for creating a pivot point on body 100 when brought into contact with body 100. Protrusions 708A, 708B may have any shape suitable for engaging body 100 at a point, thereby allowing body 100 to pivot around this point. Protrusions 708A, 708B may be triangular-shaped as shown in FIGS. 7A and 7B. However, alternatively, protrusions 708A, 708B could have the shape of pins, or other shape suitable for engaging body 100 in a manner that allows body 100 to rotate with respect to saddle 702. Pads 706A/706B and protrusions 708A/708B may be affixed to flaps 710, 712 by any suitable means including but not limited to glue, welding, screws, clips, clamps, etc. Alternatively, pads 706A and 706B may be rotatably attached to saddle 702. In this alternative embodiment, body 100 and saddle 702 could rotate with respect to pads 706A and 706B, with the resulting rotation axis of the body 100 with respect to pads 706A/706B being determined by the rotation axis of each of pads 706A and 706B. In this alternative embodiment, protrusions 708A and 708B could be omitted.

Device 700 may be employed to provide a mechanism for grasping a percussion instrument such as a drumstick that enables the instrument to pivot freely about an axis defined by the location of the protrusions 708A/708B into body 100 from pads 706A and 706B. The benefits of such rotation of body 100 were discussed earlier in this disclosure and are therefore not repeated here. Moreover, the embodiment of FIG. 7 enables a user to readily attach clip device 700 onto a drumstick body 100 and remove it from body 100 at will, in contrast to other designs in which the handle assembly that allows rotational movement is essentially permanently installed to the body 100.

Saddle 702 is preferably springingly biased toward a position suitable for grasping the outer diameter of body 100, but compliant enough to allow flaps 710, 712 to be pushed apart as saddle 702 is pushed onto the outer diameter of body 100. Clip device 700 is shown alone, and without any force being imparted thereto in FIG. 7A. FIG. 7B shows clip device 700 mounted onto body 100 of percussion instrument 10. Once clip device 700 is mounted onto body 100, a user may hold instrument 10 using pads 706A and 706B and allow the body 100 to rotate about an axis defined the locations of protrusions 708A, 708B. However, in alternative embodiments, one or both of protrusions 708A, 708B may be omitted.

Figure 8A:
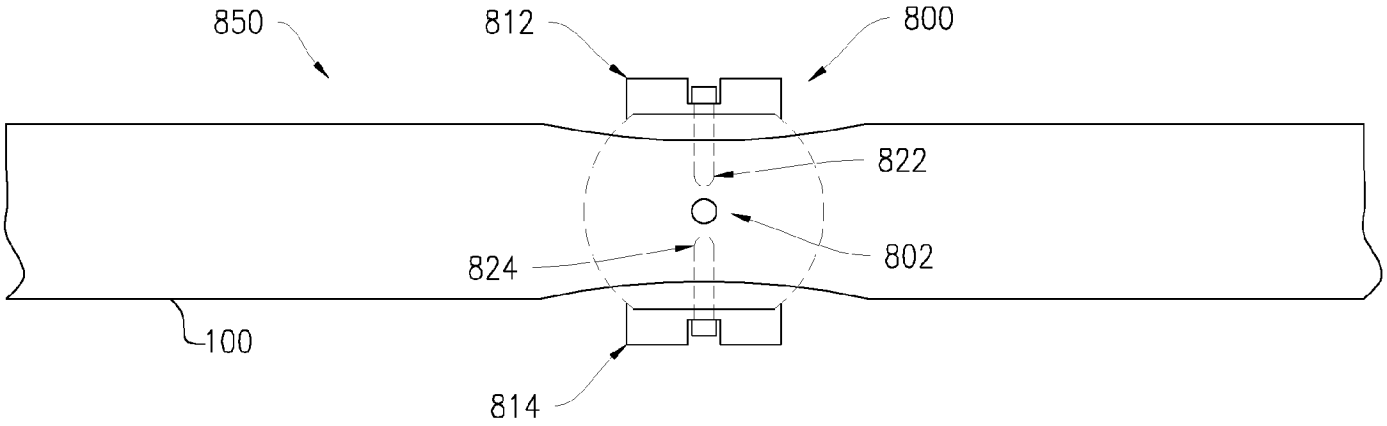
FIG. 8A is a partially sectional view and partially elevational view of a percussion instrument including a body and a wheel assembly.
Figure 8B:
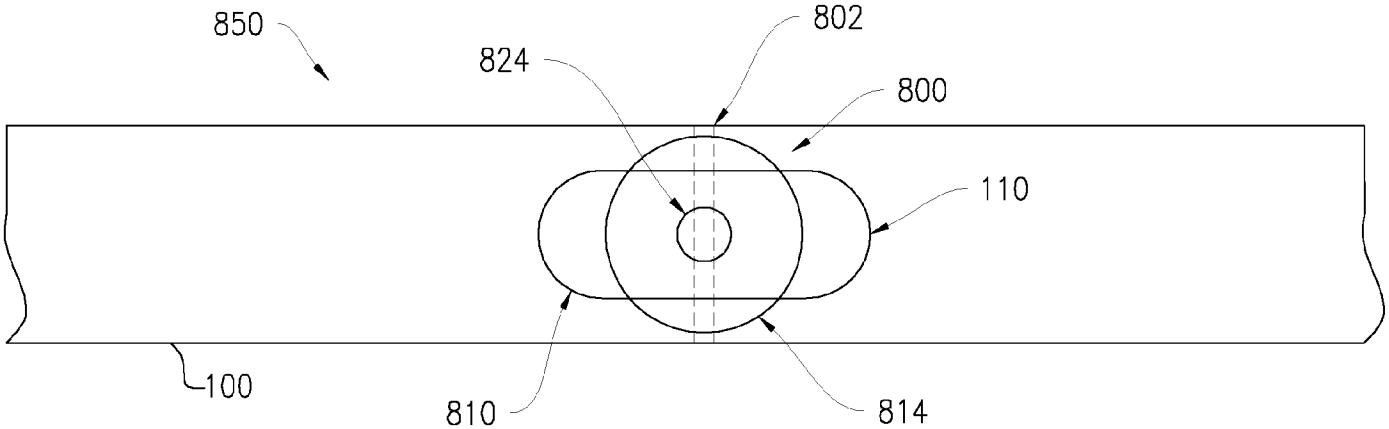
FIG. 8B is an alternate view of the percussion instrument of FIG. 8A.

FIG. 8A is a partially sectional view and partially elevational view of a percussion instrument 850 including a body 100 and a wheel assembly 800; and FIG. 8B is an alternate view of the percussion instrument of FIG. 8A.

Percussion instrument 850 provides a wheel assembly (also referred to herein as a "handle") 800 that provides a comfortable and convenient gripping surface for a user holding percussion instrument 850. In this embodiment, percussion instrument 850 includes wheel assembly 800 that rotates about the same or substantially the same axis as the percussion instrument 850 itself. This approach preferably provides a more comfortable grip on percussion instrument 850 by a user thereof.

Percussion instrument 850 may include body 100, which includes slot 110, and wheel assembly 800. Wheel assembly 800 may include pin 802, wheel (disk) 810, caps 812 and 814 (also referred to herein as "pads"), and screws 822 and 824 binding holding caps 812 and 814, respectively, to wheel 810. Disk 800 bears against, and rotates about, pin 802 and rotates within slot 110 in body 100. Pin 802, and therefore the axis of rotation of body 100, is preferably located closer to the butt end of body 100 than to the striking end thereof. As best shown in FIG. 8B, pin 802 preferably extends through a crosswise (i.e. a direction perpendicular to the longitudinal axis of body 100) hole within body 100.

Body 100 may be made of wood, plastic, or any other suitable material. Disk 800 may be made of plastic, wood, metal or any other suitable material. Caps 812, 814 may be made of metal, plastic, wood, or any other suitable material. Screws 822, 824 may be made of metal or plastic, or other suitable material.

In an embodiment, a user may use percussion instrument 850 for percussion purposes by grasping disk 810 by placing a thumb of one hand on cap 814 of wheel assembly 800 and one or more other fingers of the same hand on cap 812. Preferably, a user moves the entire percussion instrument 850 toward a percussion skin or other percussion surface while holding caps 812 and 814 of wheel 810. The motion of the longer portion of body 100, located between pin 802 and the striking end of body 100 (which may be toward the left, in the view of FIG. 8), around the axis of pin 802 moves the striking end (to the left in FIG. 8) of percussion instrument 850 toward a percussion surface for creating a percussion sound. As the longer portion of body 100 moves toward the percussion surface (not shown), the body 100 rotates (counterclockwise in the view of FIG. 8A) about to pin 802 and with respect to disk 800 which is preferably being held by the user.

As best shown in FIG. 8A, the flat portions of caps 812 and 814 may operate as limits on the angular range of rotation of body 100 with respect to wheel 810. However, in other embodiments, these limits may be altered as needed according to the requirements for a particular percussion instrument 850.

Figure 9:
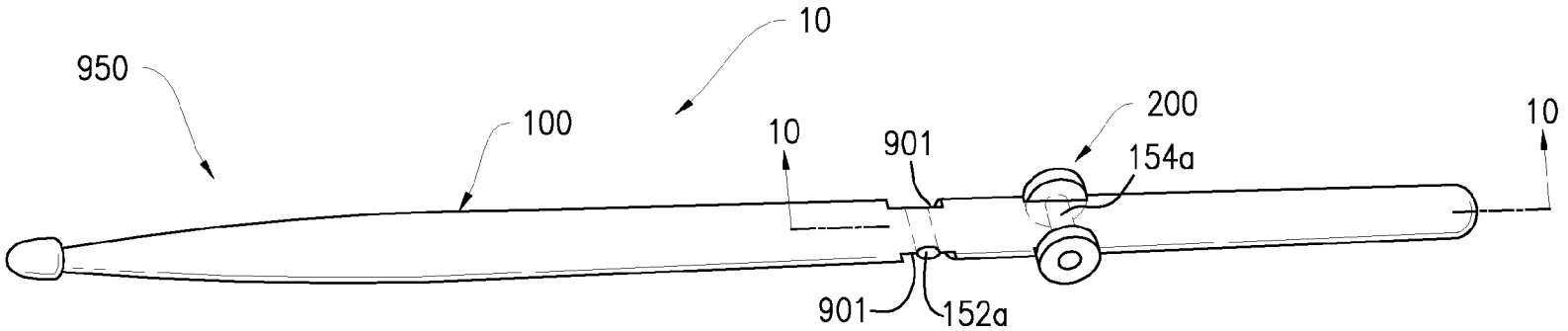
FIG. 9 is a perspective view of at least a further embodiment of a drumstick in accordance with one or more aspects of the present invention.
Figure 10:
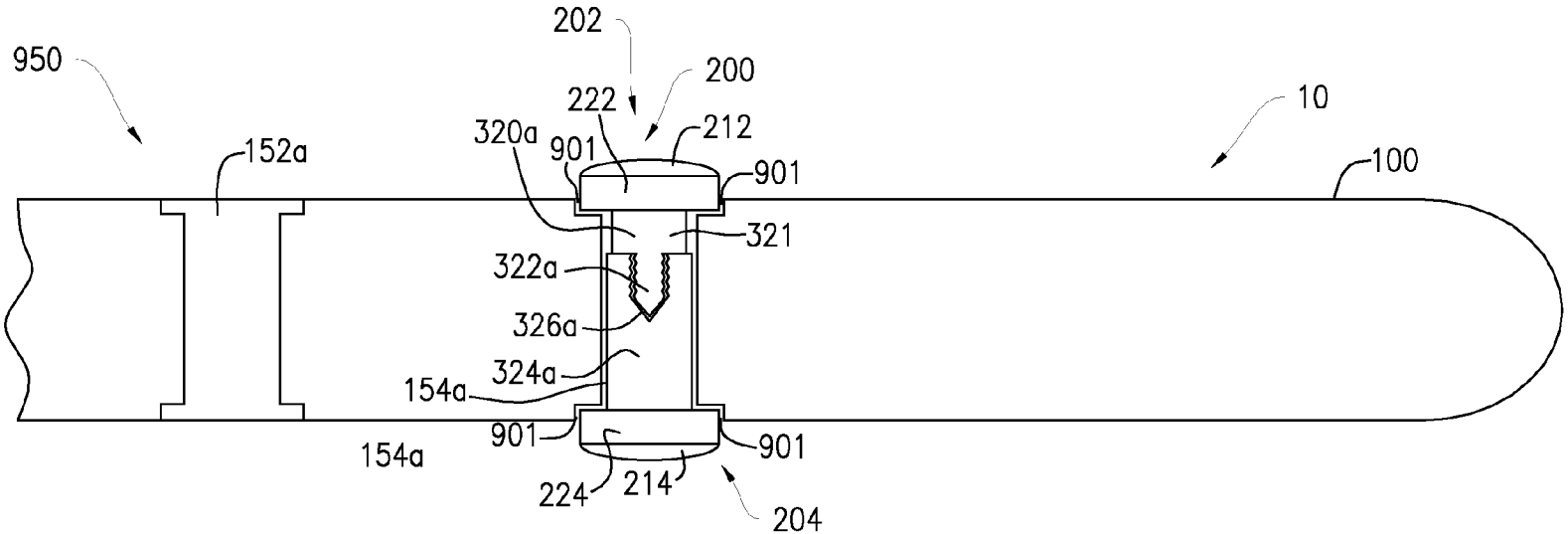
FIG. 10 is a cross-sectional view of at least a further embodiment of a drumstick taken along line 10-10 as shown in FIG. 9 in accordance with one or more aspects of the present invention.

As illustrated in FIGS. 9-10, at least a further embodiment of the present invention may comprise a percussion instrument 950, such as a drumstick 10 having a body 100 as discussed above. The body 100 may include at least two holes 152*a*, 154*a* (e.g., a third hole, such as hole 150 may not be included; alternatively, one or more of the holes 152*a*, 154*a* may be excluded in one or more embodiments or additional holes, such as hole 150, may be included in one or more further embodiments; alternatively, only one hole 150, 152*a*, 154*a* may be used.). The holes 152*a*, 154*a* may include a recessed counterbore/groove/cavity 901 (also may be referred to as a gauged out radius, depression, aperture, concave radius, spherical radius, recess, bore, groove, cavity, etc.) that operates to permit the one or more discs 222, 224 of hinge 200 and/or pads 212, 214 of discs 222, 224, respectively, to be disposed at least partially or completely therein such that the one or more discs 222, 224 and/or pads 212, 214 of the one or more discs 222, 224 may be positioned closer together (e.g., as compared with a stick that does not use such a recess or bore 901) and/or closer to the surface of the drumstick 10. Preferably, the one or more discs 222, 224 are partially in the recess 901 and partially overflow out of the recess 901. Preferably, one or more of the holes 152*a*, 154*a* each include two recessed counterbores/grooves/cavities 901 where the two recessed cavities 901 are disposed/located at, or are in communication with, each end of the holes 152*a*, 154*a* (best seen in FIG. 10). While the recesses 901 of the holes 152*a*, 154*a* are shown having edges positioned in relation to each other with substantially right angles, the geometry of the recesses 901 are not limited to this configuration and may comprise any shape (e.g., square, rectangular, circular, ovular, etc.) or size (e.g., one or more chamfered surfaces, one or more sloped surfaces, one or more rounded edges/surfaces, etc.) to accommodate a user's requirements for training, commercial expense considerations, different sizes and shapes of the discs 222, 224, ergonomic comfort of a user, etc. Preferably, each of the holes 152*a*, 154*a* has the same or substantially similar/same shape and size. Preferably, each of the holes 152*a*, 154*a* are sized and shaped to permit a hinge 200 (as discussed above and as discussed further below) to be positioned therein such that a zone of space of a predetermined size is located therebetween (e.g., the hinge 200 may be positioned in, and spaced away from, one of the holes 152*a*, 154*a* such that the hinge 200 is not in direct contact with a portion of an inside surface of the holes 152*a*, 154*a*, thereby permitting the hinge 200 to move freely within the holes 152*a*, 154*a*, or such that the hinge 200 is in contact with a portion of an inside surface of the holes 152*a*, 154*a*, thereby permitting the hinge 200 to move freely within the holes 152*a*, 154*a*, etc.). Indeed, such structure permits a user of the instrument 950 to listen for audio cues, such as clicking noises, to determine whether the user is drumming properly. Alternatively and preferably, a user of the instrument 950 may not need audio cues, such as clicking noises, to determine whether he/she is using the instrument 950 properly. Thus, the hinge 200 may move freely within the holes 152*a*, 154*a* without producing an audio cue or sound. Thus, in an alternative embodiment, the hinge 200 may be in contact with one or more inside portions of the holes 152*a*, 154*a*. By way of another example of the size and shape of the holes 152*a*, 154*a*, the grooves 901 may be sized and shaped as the grooves underneath pads 812, 814 as shown in FIG. 8A. Additionally, the hinge 200 as shown in FIGS. 9-10 may or may not include O-rings 330 and 332 as discussed above.

The percussion instrument 950 may include a hinge 200 where the disc 222 and/or the pad 212 thereof (e.g., of hinge element 202) may be connected to the disc 224 and/or the pad 214 thereof (e.g., of hinge element 204) via one or more shafts 320, 324 as discussed above. Preferably, the discs 222, 224 or a portion thereof includes a flat diameter (e.g., such as a portion of the discs 222, 224 coming out or overflowing out of the bore 901) to permit gripping the discs for easier connection or disconnection to each other (e.g., easier screwing, unscrewing, etc.) The discs 222, 224 and/or the pads 212, 214 of shafts 320*a*, 324*a* (as best seen in FIG. 10) may be connected (e.g., via clamping, tightening, snap-fitting, screwing, etc.) to each other, e.g., in similar fashion to the shafts 320, 324 of hinged elements 202, 204 as discussed above. Indeed, those skilled in the art will appreciate that the elements (e.g., the shafts 320*a*, 324*a*; threaded regions 322*a*, 326*a* of the shafts 320*a*, 324*a* as discussed further below; etc.) of the drumstick 10 may operate in similar fashion to those like-numbered elements (e.g., substantially same or similar numbers but with a letter such as 320 and 320*a*, 324 and 324*a*, 322 and 322*a*, 326 and 326*a*, etc.) as discussed above or any additional like-numbered elements discussed further herein below. For example, one or more alternative embodiments of a hinge 200 may be used (such as shown in FIGS. 11A-11E as discussed further below which may operate in a similar fashion as the hinges 200 discussed above) and may include components with alternative sizes and shape, such as, but not limited to, discs 224, 224*a*, 224*b*; pads 212, 212*a*, 214, 214*a*; threaded regions 322, 322*a*, 322*b*, 322*c*, 322*d*, 322*e*, 322*f*, 326, 326*a*, 326*b*, 326*c*, 326*d*, 326*e*, 326*f*; shafts 320, 320*a*, 320*b*, 320*c*, 320*d*, 320*e*, 320*f*, 324, 324*a*, 324*b*, 324*c*, 324*d*, 324*e*; 324*f*; etc. As discussed above, one or more components of the hinge 200, such as the hinge elements 202, 204 shafts 320*a*, 324*a*, etc., may be made of any desired material such as but not limited to wood, plastic, metal, rubber, hard rubber, polytetrafluoroethylene, carbon fiber, fiber, any combination of the foregoing, etc. One or more components of the hinge 200, such as the hinge elements 202, 204, the shafts 320*a*, 324*a*, etc., may be made of any desired material that permits the one or more components of the hinge 200 to act as a compliant material/compliance mechanism (e.g., as discussed above) that operates to permit the discs 222, 224, 224*a*, etc. to be brought closer together in response to a compressive force applied to the hinge 200. For example, one or more of the shafts 320*a*, 324*a* may include resilient or pliant material, such as rubber, that would permit the shafts 320*a*, 324*a* to compress in response to a force applied to the hinge 200, such as to the grip plates/discs 322, 324, 324*a*, etc.

Moreover, the shafts 320*a*, 324*a* (as best seen in FIG. 10) may be sized and shaped such that the shafts 320*a*, 324*a* and/or the hinge elements 202, 204 may be releasably connected, readily disconnected from one another and/or then releasably re-attached within a different available hole or re-positioned within the same hole, such as holes 152*a*, 154*a*. This disconnection and reconnection of hinge elements 202 and 204 and/or the shafts 320*a*, 324*a* may be achieved, for example, by unscrewing one of the threaded connections securing hinge elements 202, 204 together (see FIG. 10), and then re-connecting the two parts together in a different hole, selected from the other hole 152*a* or 154*a*. Preferably, the shaft 320*a* of the hinge element 202 and the shaft 324*a* of the hinge element 204 may be connected directly to each other, e.g., such that an intermediate component, such as the set screw 310 as discussed above, may not be included to complete the connection therebetween. Indeed, as discussed above for shafts 320, 324, shafts 320*a*, 324*a* may be configured to be capable of being directly screwed together without any need for an intervening set screw. For example, the shafts 320*a*, 324*a* may include threaded regions 322*a* and 326*a*, respectively, for engaging suitable portions of each other. Each of the threaded regions 322*a*, 326*a* may include a predetermined thread size (e.g., #10 thread hole, #10 thread, etc.). Moreover, other mechanical attachment means may be provided for coupling the shaft 320*a* of the hinge element 202 and the shaft 324*a* of the hinge element 204. In at least one embodiment (as shown in FIG. 10), the shaft 320*a* may include at least two portions 321 and 322*a* where the portion 321 may have a larger cross-section (such as a larger radius, larger diameter, etc.) than the cross-section of the threaded section 322*a* of the shaft 320*a*. Additionally or alternatively, the shaft 324*a* may have a larger cross-section (such as a larger radius, larger diameter, etc.) than the cross-section of the sections 321 and 322*a* of the shaft 320*a* for structural strength, alignment, to prevent buckling, etc. The shaft 324*a* may be longer than the shaft 320*a* as well. One or more alternative embodiments may include various other sizes and shapes for the shafts 320*a*, 324*a*; the threaded sections 322*a*, 326*a*; etc. as discussed further below with reference to FIGS. 11A-11E. The threaded regions 322*a*, 326*a* (e.g., as shown in FIG. 10) may be attached via the threaded connection in a predetermined location of the hole, such as substantially in the center of the hole 154*a*, such that the threaded regions 322*a*, 326*a* may be disposed substantially in between each end of the hole 154*a* (e.g. threaded regions 322*a*, 326*a* may be disposed substantially equidistantly from each end of the hole 154*a*; threaded region 322*a* may be located ¼ of the distance into the hole from the first end of the hole 154*a* while the threaded region 326*a* may be located ¾ of the distance into the hole 154*a* from the other end of the hole 154*a*; etc.).

In one or more embodiments, the shafts 320, 324, 320*a*, 324*a* as discussed above and/or shown in at least FIGS. 1-10, 11A and 11E (or other shafts discussed further below and/or shown in FIGS. 11A-11E, such as, but not limited to the shafts 320*b*, 320*c*, 320*d*, 320*e*, 320*f*, 324*b*, 324*c*, 324*d*, 324*e*, 324*f*, etc.) may be attached to the discs 222, 224, 224*a* and/or the pads 212, 212*a*, 214, 214*a* via a connection that permits the discs 222, 224, 224*a* and/or the pads 212, 212*a*, 214, 214*a* to at least one of spin, rotate, swivel, tilt, etc. on the shafts 320, 324, 320*a*, 324*a*. Such a connection may include, but is not limited to, a screw, a nail, a ball-snap connection, a pin bearing (such as a ball bearing) combination, etc. In one or more embodiments, one or more portions of the shafts 320, 324, 320*a*, 324*a* as discussed above (or other shafts discussed further below, such as, but not limited to the shafts 320*b*, 320*c*, 320*d*, 320*e*, 320*f*, 324*b*, 324*c*, 324*d*, 324*e*, 324*f*, etc.) may be in contact with at least a portion of the inside of the hole 150, 152, 154, 152*a*, 154*a* such that the shafts 320, 324, 320*a*, 324*a* as discussed above (or other shafts discussed further below, such as, but not limited to the shafts 320*b*, 320*c*, 320*d*, 320*e*, 320*f*, 324*b*, 324*c*, 324*d*, 324*e*, 324*f*, etc.) are substantially stationary or fixed in a predetermined position. Thus, the discs 222, 224, 224*a* and/or the pads 212, 212*a*, 214, 214*a* may spin, rotate, swivel, etc. while the shafts 320, 324, 320*a*, 324*a*, 320*b*, 320*c*, 320*d*, 320*e*, 320*f*, 324*b*, 324*c*, 324*d*, 324*e*, 324*f* remain substantially in its set position within one of the holes 150, 152, 154, 152*a*, 154*a*. Such structure may be employed with the recesses or bores 901 as discussed above. In one or more such embodiments, at least a portion of the discs 222, 224, 224*a* may at least one of: (i) spin, rotate, swivel or tilt inside the recesses or bores 901; and (ii) spin, rotate, swivel or tilt outside the recesses or bores 901. In at least a further embodiment, the shafts 320, 324, 320*a*, 324*a*, 320*b*, 320*c*, 320*d*, 320*e*, 320*f*, 324*b*, 324*c*, 324*d*, 324*e*, 324*f* may be integral with the body 100 of the drumstick 10.

Figure 11A:
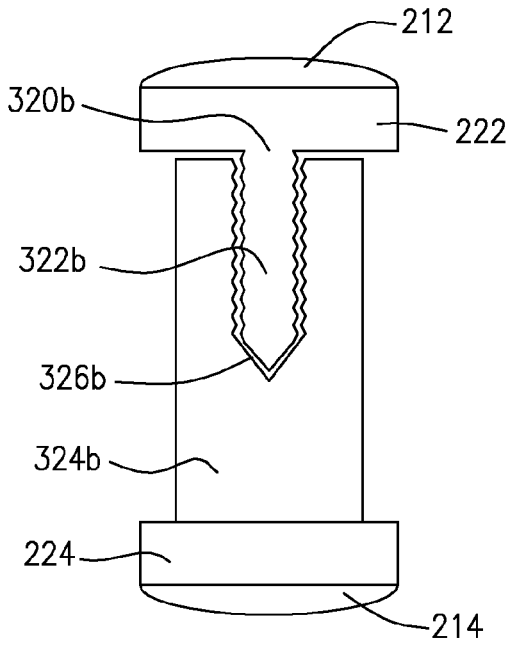
FIGS. 11A-11E are cross-sectional views of one or more further embodiments of a hinge in accordance with one or more aspects of the present invention.
Figure 11B:
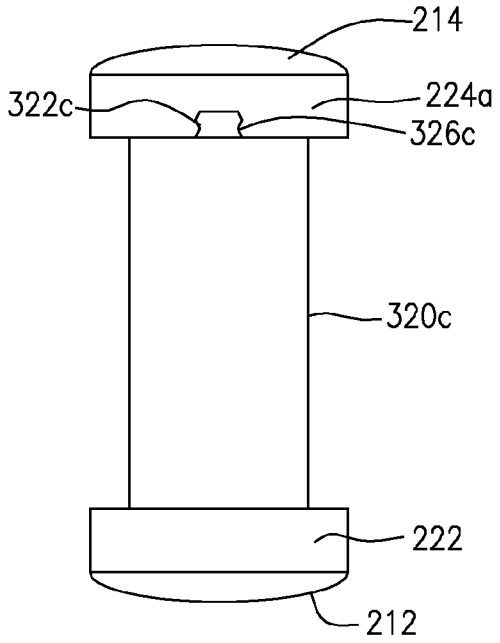
Figure 11C:
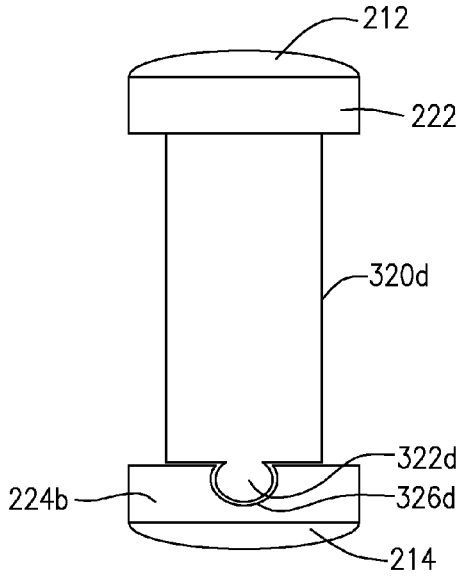
Figure 11D:
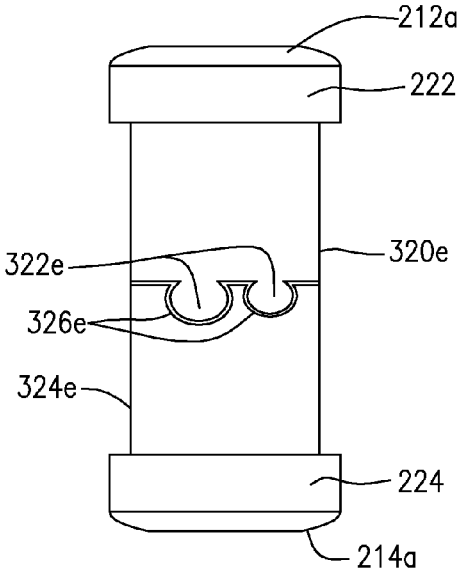
Figure 11E:
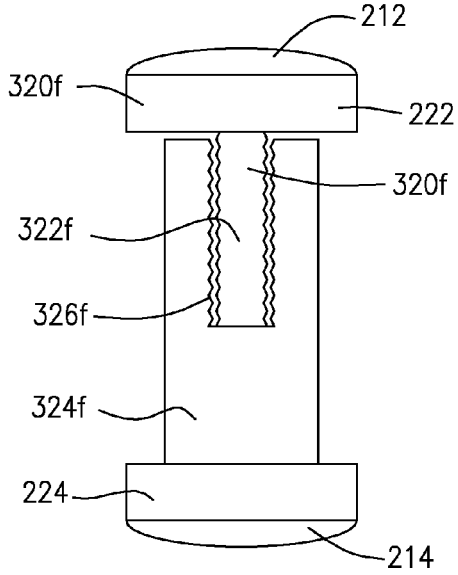

Additionally, various sizes and shapes may be used for the shafts 320*a*, 324*a*; the threaded sections 322*a*, 326*a*; the discs 222, 224, 224*a*; the pads 212, 214, 214*a*; etc. For example, as shown in FIG. 11A, the threaded region 322*b* may extend directly from the disc 222 such that no intermediate component 321 may be required. The threaded region 322*b* may threadingly connect to the threaded region 326*b* of shaft 324*b* near the middle of the hinge 200. Alternatively, as shown in FIG. 11B, the threaded region 322*c* of the shaft 320*c* may be sized and shaped to fit into a threaded region 326*c*, where the threaded region 326*c* may be disposed/located within, or in communication with, the disc 224*a* such that no shaft 324, 324*a*, 324*b* is included. Indeed, this arrangement permits the connection of the discs 222, 224*a* substantially near an end of the hinge 200 (e.g., near or in disc 224*a*, etc.). The shaft 320*c* may be sized and shaped to have substantially the same cross-section (e.g., substantially the same radius, substantially the same diameter, etc.) as the discs 222, 224*a* as shown in FIG. 11B. As shown in FIG. 11E, the threaded region 322*f* of the shaft 320*f* may extend from disc 222 and threadingly connect to the threaded region 326*f* inside the shaft 324*f*. Preferably, the threaded region 322*f* extends to and is in contact with a portion (e.g., such as the bottom, top or surface between the threads of the threaded region 326*f*, etc.) of the threaded region 326*f*. The cross-sections of the shafts 320*f*, 324*f* may be smaller than the cross-sections of the discs 222, 224. Any spacing illustrated between elements of one or more hinges 200 in FIGS. 11A-11E may be for diagrammatic illustrative purposes. Preferably, the shaft elements, e.g., 322*a*, 322*b*, 322*c*, 322*d*, 322*e*, 322*f*, 326, 326*a*, 326*b*, 326*c*, 326*d*, 326*f*, etc., are in contact with one or more portions of each other. In one or more embodiments, spacing may be employed in between such elements.

While a threaded connection is shown in at least FIGS. 9-10 11A, 11B and 11E, the present invention is not limited to this type of connection means. Other means of connecting two rods or shafts, e.g., shafts 320*a*, 324*a*, together may be employed, such as a press or snap fit (e.g., with a protrusion and a snap recess to receive that protrusion, ball-snap arrangement, etc.), friction fit, etc. Indeed, as shown in FIGS. 11C-11D, a snap or press fit connection may be employed to connect the shafts 320, 324 of the hinge 200 together. For example, as shown in FIG. 11C, the shaft 320*d* may extend from disc 222 substantially to the disc 224*b* where the shaft 320*d* includes a press or snap fit connection member 322*d* (e.g., a ball-snap element, a protrusion of a predetermined size and shape, etc.) that operates to snap or press fit into a snap or press fit receiving cavity 326*d* (e.g., such as a ball-snap shaped socket, a cavity that is sized and shaped to receive a protrusion of a predetermined size and shape, etc.). The snap or press fit receiving cavity 326*d* may be disposed/located in, and/or in communication with, the disc 224*b*. In at least a further embodiment as shown in FIG. 11D, a shaft 324*e* may extend from the disc 224 where the shaft 324*e* includes a snap or press fit receiving cavity 326*e* therein. A shaft 320*e* may extend from the disc 222 where the shaft 320*e* includes one or more press or snap fit connection members 322*e* (e.g., one or more ball-snap elements, one or more protrusions of a predetermined size and shape, etc.) that operate to snap or press fit into their respective one or more receiving cavities 326*e* (e.g., one or more ball-snap shaped sockets, one or more cavities that are sized and shaped to receive a protrusion of a predetermined size and shape, etc.). The shafts 320*e*, 324*e* may substantially meet and connect to each other near the middle of the hinge 200.

As discussed above, the pads 212, 214 may be sized and shaped depending on the desires, needs or requirements of the user of the percussion instrument 950. For example, as shown in FIG. 11D, the pads 212*a*, 214*a* may include a substantially flat or convex surface to allow a user to attain a desired grip therewith. Preferably, in one or more embodiments, the pads 212, 214 include rounded contours as shown in one or more of FIGS. 9-11C and 11E.

Additionally, the substantially perpendicular, substantially transverse, perpendicular and/or transverse hole, such as, but not limited to, the holes 150, 152, 154, 152*a*, 154*a*, etc., that extends through the body 100 of the stick 10 (e.g., across the longitudinal axis of the body 100 of the stick 10, along an axis that is not parallel to the longitudinal axis of the body 100 of the stick 10, along an axis that is transverse or substantially transverse to the longitudinal axis of the body 100 of the stick 10, along an axis that extends through the body 100 of the stick 10 and crosses over the longitudinal axis of the body 100 of the stick, along an axis that extends through, and crosses over from one side of the stick 10 to another side of the stick 10, along an axis that extends in a different direction (no matter how slight or substantial the difference) than the longitudinal axis of the body 100 of the stick 10, the two axes are different (e.g., the longitudinal axis and the axis of the hole are not parallel and are not co-linear), etc.) may be modified such that the stick 10 operates to allow a user thereof to perform one or more different drumming styles. For example, when performing the traditional, left-hand drumming style as described above (as opposed to a right hand, matched grip style or a French grip style), a user of the stick 10 having a hole (e.g., hole 150, 152, 154, 152*a*, 154*a*, etc.) may not be able to use, and/or will not feel comfortable using, the hinge 200 of the stick 10 when the hole 150, 152, 154, 152*a*, 154*a*, etc. is substantially perpendicular, substantially transverse, perpendicular and/or transverse (e.g., at about 90 degrees to both sides of the stick such that the hole 150, 152, 154, 152*a*, 154*a*, etc. is disposed at a right angle or substantially at a right angle to each side of the stick 10 when extending through the body 100 of the stick 10). This is because the drummer's wrists and/or elbow may be sticking out in the air at an uncomfortable angle or in an uncomfortable position with respect to the stick. Essentially, no drummer would want to hold his/her wrists and/or elbow in such an uncomfortable arrangement (e.g., the elbow is located away from the body for a lengthy period) when performing such drumming styles, particularly the traditional, left-hand drumming style.

Surprisingly, it has been found that, by modifying or creating the hole 150, 152, 154, 152*a*, 154*a*, etc. to have an angle (also referred to herein as "the alternative angle") that is about 10 degrees to about 45, or about 10 degrees to about 50 degrees, different from the right angle or the substantially right angle (best seen in FIG. 12), the configuration of the hinge 200 within the stick 10 would provide an efficient and optimal arrangement for the drummer such that the drummer could comfortably enjoy the benefits of the hinge 200 of the stick 10, especially for the traditional, left-hand drumming style because the drummer may comfortably rest his/her left elbow next to the drummer's body (e.g., similarly or in the same fashion as the right elbow already does). As such, depending on the angle of the holes 150, 152, 154, 152*a*, 154*a*, etc., the hinge 200 located in the hole 150, 152, 154, 152*a*, 154*a*, etc. may be used for one drumming style whereas in a hole having another angle, the hinge 200 may be used for a different drumming style or may be uncomfortable using in the same drumming style. Thus, by designing the angle of the hole 150, 152, 154, 152*a*, 154*a*, etc. based on the drumming style to be used, the drummer may use any of the described embodiments of the present invention for the one or more drumming styles in order to develop proper form while learning how to control the stick 10. While the sticks 10 are useful for teaching drummers how to perform one or more drumming styles, the sticks 10 may even be used by seasoned professionals to loosen up or warm up when training, before a performance, etc.

In one or more embodiments, the angle of the hole 150, 152, 154, 152*a*, 154*a*, etc. is preferably at least one of: positioned between about 80 degrees and about 45 degrees with respect to one or more sides of the stick 10, positioned between about 80 degrees and about 40 degrees with respect to one or more sides of the stick 10, positioned between about 70 degrees and about 45 degrees with respect to one or more sides of the stick 10, positioned between about 60 degrees and about 45 degrees with respect to one or more sides of the stick 10, positioned between about 50 degrees and about 45 degrees with respect to one or more sides of the stick 10, positioned at about 80 degrees with respect to one or more sides of the stick 10, positioned at about 75 degrees with respect to one or more sides of the stick 10, positioned at about 70 degrees with respect to one or more sides of the stick 10, positioned at about 65 degrees with respect to one or more sides of the stick 10, positioned at about 60 degrees with respect to one or more sides of the stick 10, positioned at about 55 degrees with respect to one or more sides of the stick 10, positioned at about 50 degrees with respect to one or more sides of the stick 10, positioned at about 45 degrees with respect to one or more sides of the stick 10, positioned at about 40 degrees with respect to one or more sides of the stick 10, positioned at about 35 degrees with respect to one or more sides of the stick 10, positioned at about 30 degrees with respect to one or more sides of the stick 10, positioned between about 105 degrees and about 110 degrees with respect to one or more sides of the stick 10, positioned between about 105 degrees and about 120 degrees with respect to one or more sides of the stick 10, positioned between about 105 degrees and about 130 degrees with respect to one or more sides of the stick 10, positioned between about 105 degrees and about 140 degrees with respect to one or more sides of the stick 10, positioned between about 105 degrees and about 150 degrees with respect to one or more sides of the stick 10, positioned between about 105 degrees and about 160 degrees with respect to one or more sides of the stick 10, positioned between about 105 degrees and about 170 degrees with respect to one or more sides of the stick 10, positioned at about 105 degrees with respect to one or more sides of the stick 10, positioned at about 110 degrees with respect to one or more sides of the stick 10, positioned at about 115 degrees with respect to one or more sides of the stick 10, positioned at about 120 degrees with respect to one or more sides of the stick 10, positioned at about 125 degrees with respect to one or more sides of the stick 10, positioned at about 130 degrees with respect to one or more sides of the stick 10, positioned at about 135 degrees with respect to one or more sides of the stick 10, positioned at about 140 degrees with respect to one or more sides of the stick 10, positioned at about 145 degrees with respect to one or more sides of the stick 10, positioned at about 150 degrees with respect to one or more sides of the stick 10, positioned at about 155 degrees with respect to t one or more sides of the stick 10, positioned at about 160 degrees with respect to one or more sides of the stick 10, positioned at about 165 degrees with respect to one or more sides of the stick 10, positioned at about 170 degrees with respect to one or more sides of the stick 10, and positioned at about 175 degrees with respect to one or more sides of the stick 10, etc.

Figure 12:
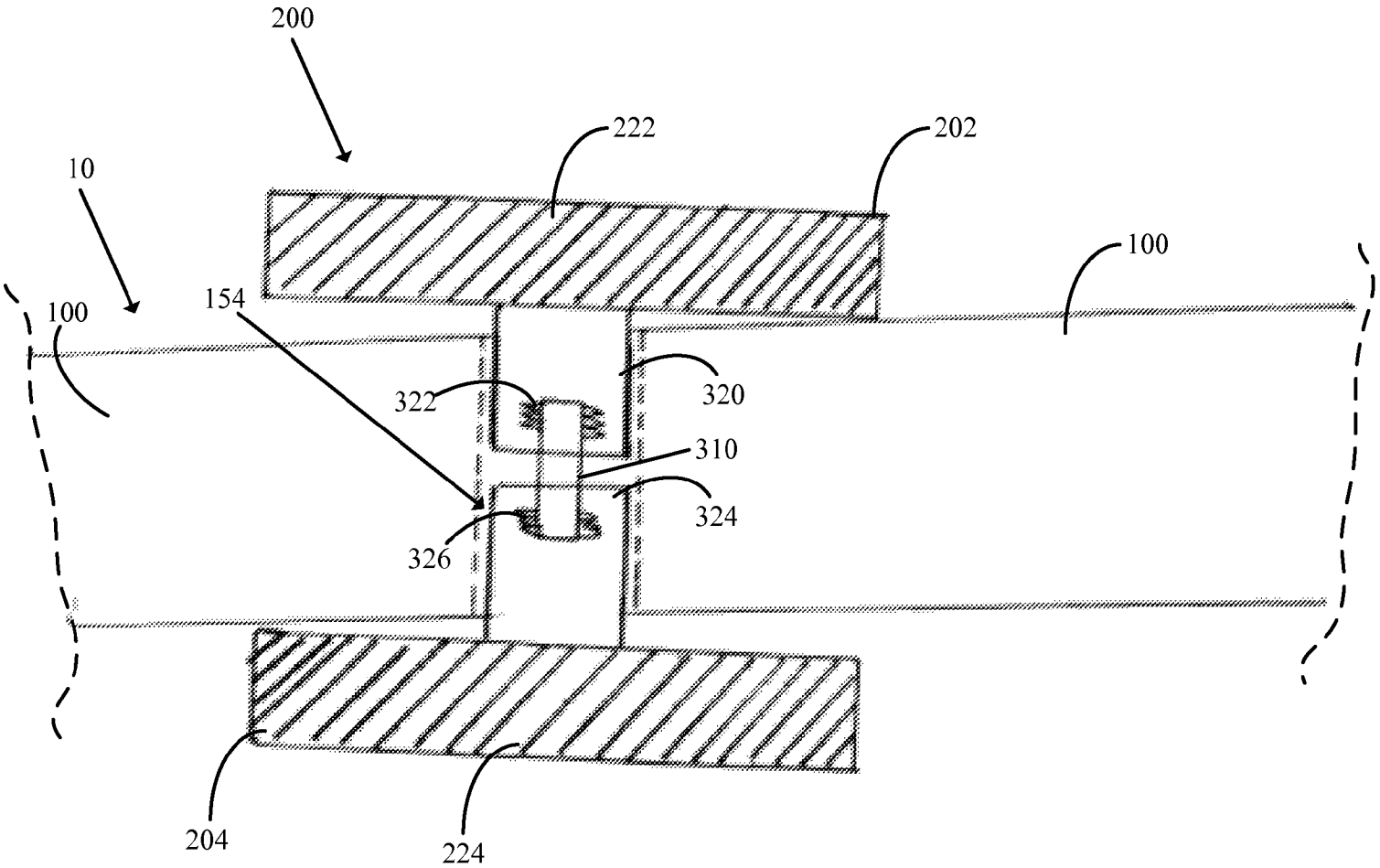
FIG. 12 is a sectional view of one or more further embodiments of a drumstick having an alternative hole extending through the body of the drumstick in accordance with one or more aspects of the present invention.
Figure 13:
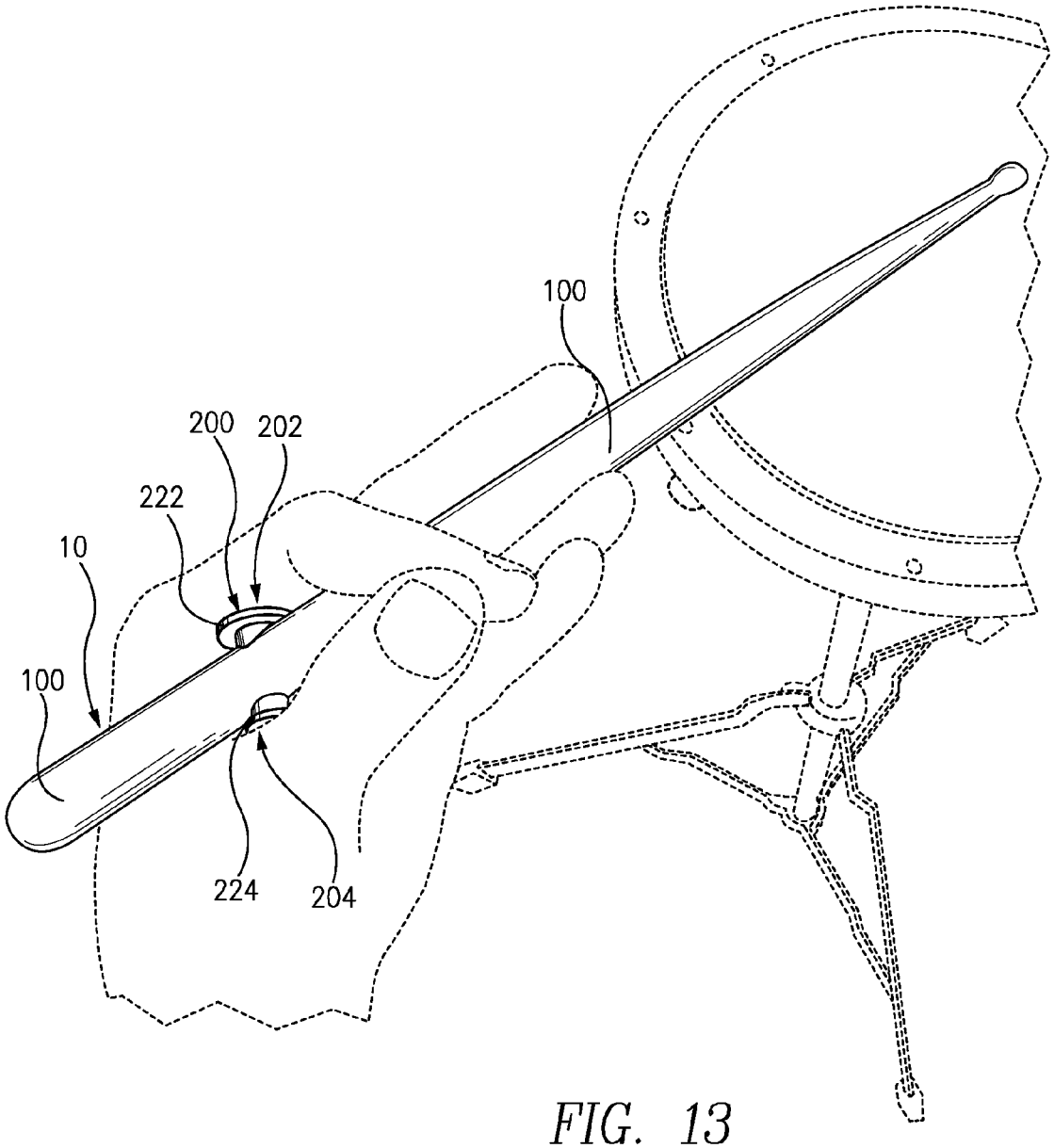
FIG. 13 is a perspective view of a drummer using one or more further embodiments of a drumstick having an alternative hole extending through the body of the drumstick in the traditional, left-hand drumming grip style in accordance with one or more aspects of the present invention.

Preferably, when looking at FIGS. 12-13 for illustrative purposes, the striking end of the body 100 of the stick 10 is the portion of the body 100 that extends beyond the right side of FIG. 12, and the butting end of the body 100 of the stick 10 is the portion of the body 100 that extends beyond the left side of FIG. 12. When performing the left-handed, traditional drumming style, preferably the hinge element 202 (as shown in FIG. 12) is located against the drummer's forefinger of the left hand (best seen in FIG. 13) such that the disc 222 is disposed against, in direct contact with, rests against, etc. the forefinger (e.g., against the base of the forefinger, at a predetermined location along the forefinger, above the base of the forefinger, etc.) of the left hand of the drummer, and the hinge element 204 (as shown in FIG. 12) is located against the drummer's thumb of the left hand (best seen in FIG. 13) such that the disc 224 is disposed against, in direct contact with, rests against, etc. the thumb (e.g., against the base of the thumb, at a predetermined location along the thumb, above the base of the thumb, etc.) of the left hand of the drummer.

Preferably, the configuration is such that the discs 222, 224 are located comfortably at the base of the index finger and at the base of the thumb in order to have the elbow rest comfortably next to the drummer's body, for which the stick 10 may employ the one or more holes 150, 152, 154, 152*a*, 154, etc. having an angle to accommodate this configuration (e.g., approximately about 30 degrees or about 35 degrees or as otherwise described above) when the user/drummer is striking a drum with the stick 10 being located in of the left hand of the user/drummer. As such, the configuration preferably has the discs 222, 224 located comfortably against, and not uncomfortably jutting into, the one or more fingers of the user/drummer.

While FIG. 12 shows the hole 154 having an angle that is about 15 degrees different from a right angle or a substantially right angle (e.g., the hole is at about a 75 degree angle or at about a 105 degree angle depending on what side of the hole you measure the angle with respect to one of the sides of the stick 10) being used with the hinge 200 having the hinge elements 202, 204 with the discs 222, 224, the shafts 320, 324 having the threaded regions 322, 326 and the set screw 310 (e.g., similar to, or the same as, the hinge 200 as described above with respect to FIG. 5), the hole 154 having such an angle may be used with any type of hinge 200 or any other arrangement thereof described herein. For example, the hole 154 having the alternative angle may be used with, but is not limited to use with only, one or more of the following: the grooves 901 (see e.g., FIGS. 9-10); any of the components with alternative sizes and shapes as described above for FIGS. 11A-11E; the hinge clip device 700; one or more of the O-rings 330, 332; the compliance mechanism(s), such as, but not limited to the springs 410, 420, etc. While FIG. 12 shows a portion of the body 100 having the hole 154 therein and not the other portions of the body (i.e., as illustratively indicated by the dashed lines on ends of the portion of the body 100 having the hole 154 therein), such as, but not limited to, the portion(s) having holes 150, 152, etc., the hinge 200 may be positioned within the stick 10 when employing any of the other holes 150, 152, 154, 152*a*, 154*a*, etc. discussed herein. After all, while FIG. 12 focuses on the hole 154 for purposes of describing this aspect of the invention, a zoomed out view of FIG. 12 would show the remaining portions of the stick 10, including, for example, holes 150, 152, etc., the striking end of the stick 10 (as extending to the right side of FIG. 12 as explained above), the butt end of the stick 10 (as extending to the left side of FIG. 12 as explained above), and any other contours of the body 100 of the stick 10.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A percussion instrument comprising:

a body having a longitudinal axis extending from a butt end to a striking end thereof and at least one hole extending through the thickness of the body substantially along and/or through an axis that is different from the longitudinal axis;

a grasping mechanism having a first grip plate at a first end thereof and a second grip plate at a second end thereof, at least one shaft extending from the first grip plate through a first hole of the at least one hole in the body to the second grip plate, and a releasable connection between the first grip plate and the second grip plate such that the grasping mechanism operates to be positioned in the first hole of the at least one hole and the first grip plate and the second grip plate operate to be disconnected from each other and/or connected/re-connected to each other such that the grasping mechanism operates to be positioned or re-positioned in the at least one hole; and a compliance mechanism disposed between the first and second grip plates, enabling the first and second grip plates to be moved closer together in response to a compressive force applied to the grasping mechanism, wherein the at least one hole extending through the thickness of the body is disposed at an angle other than ninety degrees with respect to the body.

2. The percussion instrument of claim 1, wherein the at least one hole is sized and shaped such that the grasping mechanism operates to permit a user of the percussion instrument to hold the body in, or to perform in, the traditional, left-hand drumming grip style.

3. The percussion instrument of claim 2, wherein:

(i) the body includes at least a first side extending between the butt end and the striking end of the body and at least a second side extending between the butt end and the striking end of the body; and (ii) the angle of the at least one hole is at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees w with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

4. The percussion instrument of claim 1, wherein the releasable connection comprises at least one of: a screw; a threaded connection; a snap or press fit connection and a friction fit connection.

5. The percussion instrument of claim 1, wherein the first hole of the at least one hole includes at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (i) closer to each other than when not having the at least one recess or bore; and/or (ii) closer to the surface of the body of the percussion instrument.

6. The percussion instrument of claim 5, wherein at least the first hole of the at least one hole includes at least one of: (i) a first recess or bore of the at least one recess or bore at a first end of the first hole operating to permit at least a portion of the first grip plate to be disposed therein; and (ii) a second recess or bore of the at least one recess or bore at a second end of the first hole operating to permit at least a portion of the second grip plate to be disposed therein.

7. The percussion instrument of claim 6, wherein the at least one hole comprises at least two holes, each of the at least two holes including the first and second recesses or bores at respective ends thereof.

8. The percussion instrument of claim 1, wherein at least one of:

(i) at least one of the first grip plate and the second grip plate includes a pad thereon, the pad operating to provide a comfortable and/or ergonomic surface for gripping at least the grasping mechanism of the percussion instrument; and (ii) the pad includes a surface that is at least one of: curved, sloped, chamfered, convex, concave, rounded, substantially flat, and recessed.

9. The percussion instrument of claim 1, wherein the at least one hole is sized and shaped to operate to at least one of:

permit the grasping mechanism and/or the compliance mechanism to be positioned therein such that a zone of space of a predetermined size is located between the at least one hole and the grasping mechanism and/or the compliance mechanism, thereby permitting the grasping mechanism and/or the compliance mechanism to move freely within the at least one hole;

permit the grasping mechanism and/or the compliance mechanism to be positioned therein and to be spaced away therefrom such that the grasping mechanism and/or the compliance mechanism operates to make one or more audible noises when hitting against the first hole of the at least one hole, thereby permitting the grasping mechanism and/or the compliance mechanism to move freely within the at least one hole; and permit the grasping mechanism and/or the compliance mechanism to be positioned therein and to be in contact with at least a portion thereof.

10. The percussion instrument of claim 1, wherein one or more components of at least one of the grasping mechanism, the compliance mechanism and the body are made of at least one of: wood, plastic, metal, rubber, hard rubber, polytetrafluoroethylene, carbon fiber, and fiber.

11. The percussion instrument of claim 1, wherein at least one of:

(i) the at least one shaft of the grasping mechanism is substantially stationary or fixed in a predetermined position within the at least one hole and at least one of the first grip plate and the second grip plate are connected to the at least one shaft such that the at least one of the first grip plate and the second grip plate at least one of spin, rotate, swivel and tilt on respective ends of the grasping mechanism;

(ii) the at least one shaft of the grasping mechanism is substantially stationary or fixed in a predetermined position within the at least one hole and at least one of the first grip plate and the second grip plate are connected to the at least one shaft such that the at least one of the first grip plate and the second grip plate at least one of spin, rotate, swivel and tilt on respective ends of the grasping mechanism, wherein the connection between the at least one shaft and the at least one of the first grip plate and the second grip plate comprises at least one of: a screw, a nail, a ball-snap combination, a pin-bearing combination, and a pin-ball bearing combination;

(iii) at least a portion of the at least one shaft of the grasping mechanism is in contact with at least a portion of an inside wall of the at least one hole such that the at least one shaft is substantially stationary or fixed in a predetermined position within the at least one hole;

(iv) at least one of the first grip plate and the second grip plate are connected to the at least one shaft such that the at least one of the first grip plate and the second grip plate at least one of spin, rotate, swivel and tilt on respective ends of the grasping mechanism; and (v) the at least one shaft is integral with the body.

12. A percussion instrument comprising:

a body having a longitudinal axis extending from a butt end to a striking end thereof and at least one hole extending through the thickness of the body substantially along and/or through an axis that is different from the longitudinal axis; and a grasping mechanism having a first grip plate at a first end thereof and a second grip plate at a second end thereof, at least one shaft extending from the first grip plate through a first hole of the at least one hole in the body to the second grip plate, and a releasable connection between the first grip plate and the second grip plate such that the grasping mechanism operates to be positioned in the first hole of the at least one hole and the first grip plate and the second grip plate operate to be disconnected from each other and/or connected/re-connected to each other such that the grasping mechanism operates to be positioned or re-positioned in the at least one hole, wherein the at least one hole extending through the thickness of the body is disposed at an angle other than ninety degrees with respect to the body.

13. The percussion instrument of claim 12, wherein the at least one hole is sized and shaped such that the grasping mechanism operates to permit a user of the percussion instrument to hold the body in, or to perform in, the traditional, left-hand drumming grip style.

14. The percussion instrument of claim 13, wherein:

(i) the body includes at least a first side and at least a second side extending from the butt end to the striking end thereof; and (ii) the angle of the at least one hole is at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees w with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

15. The percussion instrument of claim 12, wherein the releasable connection comprises at least one of: a screw; a threaded connection; a snap or press fit connection and a friction fit connection.

16. The percussion instrument of claim 12, wherein the first hole of the at least one hole includes at least one recess or bore disposed or located substantially at an end of the first hole, the at least one recess or bore being sized and/or shaped to receive at least a portion of at least one of the first grip plate and the second grip plate therein such that the at least one recess or bore operates to permit the first grip plate and/or the second grip plate to be positioned at least one of: (i) closer to each other than when not having the at least one recess or bore; and/or (ii) closer to the surface of the body of the percussion instrument.

17. The percussion instrument of claim 16, wherein at least the first hole of the at least one hole includes at least one of: (i) a first recess or bore of the at least one recess or bore at a first end of the first hole operating to permit at least a portion of the first grip plate to be disposed therein; and (ii) a second recess or bore of the at least one recess or bore at a second end of the first hole operating to permit at least a portion of the second grip plate to be disposed therein.

18. The percussion instrument of claim 17, wherein the at least one hole comprises at least two holes, each of the at least two holes including the first and second recesses or bores at respective ends thereof.

19. The percussion instrument of claim 12, wherein at least one of:

(i) at least one of the first grip plate and the second grip plate includes a pad thereon, the pad operating to provide a comfortable and/or ergonomic surface for gripping at least the grasping mechanism of the percussion instrument; and (ii) the pad includes a surface that is at least one of: curved, sloped, chamfered, convex, concave, rounded, substantially flat, and recessed.

20. The percussion instrument of claim 12, wherein the at least one hole is sized and shaped to operate to at least one of:

permit the grasping mechanism to be positioned therein such that a zone of space of a predetermined size is located therebetween, thereby permitting the grasping mechanism to move freely within the at least one hole;

permit the grasping mechanism to be positioned therein and to be spaced away therefrom such that the grasping mechanism operates to make one or more audible noises when hitting against the first hole of the at least one hole, thereby permitting the grasping mechanism to move freely within the at least one hole; and permit the grasping mechanism to be positioned therein and to be in contact with at least a portion thereof.

21. The percussion instrument of claim 12, wherein one or more components of at least the grasping mechanism and the body are made of at least one of: wood, plastic, metal, rubber, hard rubber, polytetrafluoroethylene, carbon fiber, and fiber.

22. The percussion instrument of claim 12, wherein at least one of:

(i) the at least one shaft of the grasping mechanism is substantially stationary or fixed in a predetermined position within the at least one hole and at least one of the first grip plate and the second grip plate are connected to the at least one shaft such that the at least one of the first grip plate and the second grip plate at least one of spin, rotate, swivel and tilt on respective ends of the grasping mechanism;

(ii) the at least one shaft of the grasping mechanism is substantially stationary or fixed in a predetermined position within the at least one hole and at least one of the first grip plate and the second grip plate are connected to the at least one shaft such that the at least one of the first grip plate and the second grip plate at least one of spin, rotate, swivel and tilt on respective ends of the grasping mechanism, wherein the connection between the at least one shaft and the at least one of the first grip plate and the second grip plate comprises at least one of: a screw, a nail, a ball-snap combination, a pin-bearing combination, and a pin-ball bearing combination;

(iii) at least a portion of the at least one shaft of the grasping mechanism is in contact with at least a portion of an inside wall of the at least one hole such that the at least one shaft is substantially stationary or fixed in a predetermined position within the at least one hole;

(iv) at least one of the first grip plate and the second grip plate are connected to the at least one shaft such that the at least one of the first grip plate and the second grip plate at least one of spin, rotate, swivel and tilt on respective ends of the grasping mechanism; and (v) the at least one shaft is integral with the body.

23. A percussion instrument comprising:

a body having a longitudinal axis extending from a butt end to a striking end thereof and at least one hole extending through the thickness of the body substantially along and/or through an axis that is different from the longitudinal axis; and a hinge having a first disc at a first end thereof and a second disc at a second end thereof, at least one shaft extending from the first disc through the at least one hole in the body to the second disc, and a releasable connection between the first disc and the second disc such that the grasping mechanism operates to be positioned in the at least one hole and the first disc and the second disc operate to be disconnected from each other and/or connected/re-connected to each other such that the hinge operates to be positioned in another of the at least one hole and/or re-positioned in the at least one hole, wherein the at least one hole extending through the thickness of the body is disposed at an angle other than ninety degrees with respect to the body.

24. The percussion instrument of claim 23, wherein the at least one hole is sized and shaped such that the grasping mechanism operates to permit a user of the percussion instrument to hold the body in, or to perform in, the traditional, left-hand drumming grip style.

25. The percussion instrument of claim 24, wherein:

(i) the body includes at least a first side and at least a second side extending from the butt end to the striking end thereof; and (ii) the angle of the at least one hole is at least one of: positioned between about 80 degrees and about 45 degrees with respect to the first side or the second side, positioned between about 80 degrees and about 40 degrees with respect to the first side or the second side, positioned between about 70 degrees and about 45 degrees with respect to the first side or the second side, positioned between about 60 degrees and about 45 degrees w with respect to the first side or the second side, positioned between about 50 degrees and about 45 degrees with respect to the first side or the second side, positioned at about 80 degrees with respect to the first side or the second side, positioned at about 75 degrees with respect to the first side or the second side, positioned at about 70 degrees with respect to the first side or the second side, positioned at about 65 degrees with respect to the first side or the second side, positioned at about 60 degrees with respect to with respect to the first side or the second side, positioned at about 55 degrees with respect to with respect to the first side or the second side, positioned at about 50 degrees with respect to the first side or the second side, positioned at about 45 degrees with respect to the first side or the second side, positioned at about 40 degrees with respect to the first side or the second side, positioned at about 35 degrees with respect to the first side or the second side, positioned at about 30 degrees with respect to the first side or the second side, positioned between about 105 degrees and about 110 degrees with respect to the first side or the second side, positioned between about 105 degrees and about 120 degrees with respect to the first side or the second side, positioned between about 105 degrees and about 130 degrees with respect to the first side or the second side, positioned between about 105 degrees and about 140 degrees with respect to the first side or the second side, positioned between about 105 degrees and about 150 degrees with respect to the first side or the second side, positioned between about 105 degrees and about 160 degrees with respect to the first side or the second side, positioned between about 105 degrees and about 170 degrees with respect to the first side or the second side, positioned at about 105 degrees with respect to the first side or the second side, positioned at about 110 degrees with respect to the first side or the second side, positioned at about 115 degrees with respect to the first side or the second side, positioned at about 120 degrees with respect to the first side or the second side, positioned at about 125 degrees with respect to the first side or the second side, positioned at about 130 degrees with respect to the first side or the second side, positioned at about 135 degrees with respect to the first side or the second side, positioned at about 140 degrees with respect to the first side or the second side, positioned at about 145 degrees with respect to the first side or the second side, positioned at about 150 degrees with respect to the first side or the second side, positioned at about 155 degrees with respect to the first side or the second side, positioned at about 160 degrees with respect to the first side or the second side, positioned at about 165 degrees with respect to the first side or the second side, positioned at about 170 degrees with respect to the first side or the second side, and positioned at about 175 degrees with respect to the first side or the second side.

26. The percussion instrument of claim 23, wherein the releasable connection comprises at least one of: a screw; a threaded connection; a snap or press fit connection and a friction fit connection.

27. The percussion instrument of claim 23, wherein at least one of:

(i) the at least one hole includes at least one recess or bore disposed or located substantially at an end thereof, the at least one recess or bore being sized and/or shaped to receive at least a portion of at least one of the first disc and the second disc therein such that the at least one recess or bore operates to permit the first disc and/or the second disc to be positioned at least one of: closer to each other than when not having the at least one recess or bore and closer to the surface of the body of the percussion instrument;

(ii) the releasable connection comprises at least one of: a threaded connection; a snap or press fit connection and a friction fit connection;

(iii) the at least one hole includes at least one of: a first of the at least one recess or bore at a first end of the at least one hole operating to permit at least a portion of the first disc to be disposed therein; and a second of the at least one recess or bore at a second end of the at least one hole operating to permit at least a portion of the second disc to be disposed therein;

(iv) at least one of the first disc and the second disc includes a pad thereon, the pad operating to provide a more comfortable and/or ergonomic surface for gripping at least the hinge of the percussion instrument and the pad including a surface that is at least one of: curved, sloped, chamfered, convex, concave, rounded, substantially flat, and recessed;

(v) the at least one hole is sized and shaped to operate to at least one of:

permit the hinge to be positioned therein such that a zone of space of a predetermined size is located therebetween, thereby permitting the hinge to move freely within the at least one hole;

permit the hinge to be positioned therein and to be spaced away therefrom such that the hinge operates to make one or more audible noises when hitting against the at least one hole, thereby permitting the hinge to move freely within the at least one hole; and permit the hinge to be positioned therein and to be in contact with at least a portion thereof; and (vi) one or more components of at least one of the hinge and body are made of at least one of: wood, plastic, metal, rubber, hard rubber, polytetrafluoroethylene, carbon fiber, and fiber.

28. The percussion instrument of claim 27, wherein at least one of:

(i) the at least one shaft of the hinge is substantially stationary or fixed in a predetermined position within the at least one hole and at least one of the first disc, the second disc, the pad of the first disc and the pad of the second disc are connected to the at least one shaft such that the at least one of the first disc, the second disc, the pad of the first disc and the pad of the second disc at least one of spin, rotate, swivel and tilt on respective ends of the hinge;

(ii) the at least one shaft of the hinge is substantially stationary or fixed in a predetermined position within the at least one hole and at least one of the first disc, the second disc, the pad of the first disc and the pad of the second disc are connected to the at least one shaft such that the at least one of the first disc, the second disc, the pad of the first disc and the pad of the second disc at least one of spin, rotate, swivel and tilt on respective ends of the hinge, wherein the connection between the at least one shaft and the at least one of the first disc, the second disc, the pad of the first disc and the pad of the second disc comprises at least one of: a screw, a nail, a ball-snap combination, a pin-bearing combination, and a pin-ball bearing combination;

(iii) at least a portion of the at least one shaft of the hinge is in contact with at least a portion of an inside wall of the at least one hole such that the at least one shaft is substantially stationary or fixed in a predetermined position within the at least one hole;

(iv) at least one of the first disc, the second disc, the pad of the first disc and the pad of the second disc are connected to the at least one shaft such that the at least one of the first disc, the second disc, the pad of the first disc and the pad of the second disc at least one of spin, rotate, swivel and tilt on respective ends of the hinge;

(v) the at least one shaft is integral with the body; and (vi) at least one of the first disc, the second disc, the pad of the first disc and the pad of the second disc are connected to the at least one shaft such that the at least one of the first disc, the second disc, the pad of the first disc and the pad of the second disc at least one of spin, rotate, swivel and tilt on respective ends of the hinge, wherein at least one of the first disc, the second disc, the pad of the first disc and the pad of the second disc at least one of:

spin, rotate, swivel and tilt inside the at least one recess or bore; and spin, rotate, swivel and tilt outside the at least one recess or bore.

* * * * *